US012391501B2

(12) United States Patent
Konishi

(10) Patent No.: US 12,391,501 B2
(45) Date of Patent: Aug. 19, 2025

(54) PAPER FEED DEVICE, IMAGE FORMATION SYSTEM, AND CONTROL PROGRAM FOR PAPER FEED DEVICE

(71) Applicant: Konica Minolta, Inc., Tokyo (JP)

(72) Inventor: Hiroyuki Konishi, Tokyo (JP)

(73) Assignee: KONICA MINOLTA, INC., Tokyo (JP)

( * ) Notice: Subject to any disclaimer, the term of this patent is extended or adjusted under 35 U.S.C. 154(b) by 159 days.

(21) Appl. No.: 17/829,201

(22) Filed: May 31, 2022

(65) Prior Publication Data

US 2022/0388795 A1 Dec. 8, 2022

(30) Foreign Application Priority Data

Jun. 7, 2021 (JP) ..... 2021-094950

(51) Int. Cl.

*B65H 9/00* (2006.01)
*B65H 9/06* (2006.01)
*B65H 9/20* (2006.01)

(52) U.S. Cl.

CPC ..... *B65H 9/20* (2013.01); *B65H 9/004* (2013.01); *B65H 9/06* (2013.01); *B65H 2511/135* (2013.01); *B65H 2511/416* (2013.01); *B65H 2515/10* (2013.01); *B65H 2801/06* (2013.01)

(58) Field of Classification Search

CPC ..... B65H 9/06
See application file for complete search history.

(56) References Cited

U.S. PATENT DOCUMENTS 8,437,683 B2 * 5/2013 Suzuki ..... B65H 3/48 399/397
2006/0255531 A1 * 11/2006 Azzopardi ..... B65H 1/04 271/171
2011/0175282 A1 * 7/2011 Sagawa ..... B65H 9/101 271/265.01
2020/0140215 A1 * 5/2020 Ogasawara ..... B65H 7/16

FOREIGN PATENT DOCUMENTS

JP H11292305 A 10/1999
JP 2009-104116 A 5/2009
JP 2020-070166 A 5/2020

OTHER PUBLICATIONS

Notice of Reasons for Refusal dated Dec. 12, 2024, for Japanese Patent Application No. 2021-094950, 12 pages.
Decision of Refusal dated Mar. 27, 2025, for Japanese Patent Application No. 2021-094950, with English translation, 11 pages.

* cited by examiner

*Primary Examiner* — Howard J Sanders
(74) *Attorney, Agent, or Firm* — Squire Patton Boggs (US) LLP

(57) ABSTRACT

A paper feed device having regulation plates that are movable on a paper feed tray for loading paper and regulate edges of the paper, includes: a driver that moves the regulation plates; and a hardware processor that acquires paper information corresponding to a characteristic of the loaded paper, and causes the driver to move the regulation plates according to the acquired paper information.

19 Claims, 20 Drawing Sheets

FIG. 9

| SIZE | PAPER TYPE | BASIS WEIGHT g/m$^2$ | HUMIDITY | CD PROPER REGULATION PLATE POSITION mm |
|---|---|---|---|---|
| SRA3 | PLAIN PAPER (THICKER THAN THICK PAPER 4) | 257– | H | 451.2 |
| | | | M | 451.5 |
| | | | L | 451.8 |
| | PLAIN PAPER (THICK PAPER 3, 4) | 210–256 | H | 450.7 |
| | | | M | 451.0 |
| | | | L | 451.3 |
| | PLAIN PAPER (THICK PAPER 1, 2) | 91–209 | H | 450.2 |
| | | | M | 450.5 |
| | | | L | 450.8 |
| | PLAIN PAPER (NORMAL) | 60–90 | H | 449.7 |
| | | | M | 450.0 |
| | | | L | 450.3 |
| | PLAIN PAPER (THIN PAPER) | –59 | H | 449.2 |
| | | | M | 449.5 |
| | | | L | 449.8 |
| | COATED PAPER | ・・・ | ・・ | ・・・ |
| | HIGH-QUALITY PAPER | ・・・ | ・・ | ・・・ |
| | ・・・ | ・・・ | ・・ | ・・・ |
| A3S | ・・・ | ・・・ | ・・ | ・・・ |
| | ・・・ | ・・・ | ・・ | ・・・ |
| ・・・ | ・・・ | ・・・ | ・・ | ・・・ |
| ・・・ | ・・・ | ・・・ | ・・ | ・・・ |

FIG. 11

| SIZE | PAPER NAME (PAPER PROFILE) | HUMIDITY | CD PROPER REGULATION PLATE POSITION mm |
|---|---|---|---|
| SRA3 | ABC COMPANY KENT PAPER 123 | H | 451.2 |
| | | M | 451.5 |
| | | L | 451.8 |
| | DEF COMPANY COPIER PAPER 456 | H | 450.7 |
| | | M | 451.0 |
| | | L | 451.3 |
| | ABC COMPANY HIGH-QUALITY PAPER No10 | H | 450.2 |
| | | M | 450.5 |
| | | L | 450.8 |
| | GH COMPANY PAPER #1 | H | 449.7 |
| | | M | 450.0 |
| | | L | 450.3 |
| | ABC COMPANY COPIER PAPER 123 | H | 449.2 |
| | | M | 449.5 |
| | | L | 449.8 |
| | LMN COMPANY COPIER PAPER NUMBER 1 | H | 450.7 |
| | | M | 451.0 |
| | | L | 451.3 |
| | XYZ COMPANY No1 PAPER A3 NOBI | H | 449.7 |
| | | M | 450.0 |
| | | L | 450.3 |
| | zzz COMPANY HIGH-QUALITY PAPER 123 | | ・・・ |
| A3S | xxx COMPANY COPIER PAPER RAS3 | | ・・・ |
| | ・・・ | | ・・・ |
| ・・・ | ・・・ | | ・・・ |
| ・・・ | ・・・ | | ・・・ |

FIG. 16

| SIZE | PAPER TYPE | BASIS WEIGHT g/m$^2$ | HUMIDITY | CD REGULATION PLATE POSITION mm | NUMBER OF A JAM OCCURRENCES | NUMBER OF B JAM OCCURRENCES |
|---|---|---|---|---|---|---|
| SRA3 | PLAIN PAPER (THICKER THAN THICK PAPER 4) | 257– | H | 451.0 | 0 | 0 |
| | | | | 451.1 | 0 | 0 |
| | JAM1 | | | 451.2 | 2→3 | 0 |
| | | | | 451.3 | 0 | 0 |
| | | | | 451.4 | 0 | 0 |
| | | | M | 451.3 | 0 | 0 |
| | | | | 451.4 | 0 | 4 |
| | JAM2 | | | 451.5 | 0 | 2→3 |
| | | | | 451.6 | 0 | 0 |
| | | | | 451.7 | 0 | 0 |
| | | | L | ・・・ | ・・・ | ・・・ |
| | PLAIN PAPER (THICK PAPER 3, 4) | 210–256 | ・・ | ・・・ | ・・・ | ・・・ |
| | PLAIN PAPER (THICK PAPER 1, 2) | 91–209 | ・・ | ・・・ | ・・・ | ・・・ |
| | PLAIN PAPER (NORMAL) | 60–90 | ・・ | ・・・ | ・・・ | ・・・ |
| | PLAIN PAPER (THIN PAPER) | –59 | ・・ | ・・・ | ・・・ | ・・・ |
| | COATED PAPER | ・・・ | ・・ | ・・・ | ・・・ | ・・・ |
| | HIGH-QUALITY PAPER | ・・・ | ・・ | ・・・ | ・・・ | ・・・ |
| A3S | ・・・ | ・・・ | ・・ | ・・・ | ・・・ | ・・・ |
| | ・・・ | ・・・ | ・・ | ・・・ | ・・・ | ・・・ |
| ・・・ | ・・・ | ・・・ | ・・ | ・・・ | ・・・ | ・・・ |
| ・・・ | ・・・ | ・・・ | ・・ | ・・・ | ・・・ | ・・・ |

FIG. 19

| SIZE | PAPER TYPE | BASIS WEIGHT $g/m^2$ | HUMIDITY | CD PROPER REGULATION PLATE POSITION mm |
|---|---|---|---|---|
| SRA3 | PLAIN PAPER (THICKER THAN THICK PAPER 4) | 257– | H | 451.2→451.2 |
| | | | M | 451.5 |
| | | | L | 451.8 |
| | PLAIN PAPER (THICK PAPER 3, 4) | 210–256 | H | 450.7 |
| | | | M | 451.0 |
| | | | L | 451.3 |
| | PLAIN PAPER (THICK PAPER 1, 2) | 91–209 | H | 450.2 |
| | | | M | 450.5 |
| | | | L | 450.8 |
| | PLAIN PAPER (NORMAL) | 60–90 | H | 449.7 |
| | | | M | 450.0 |
| | | | L | 450.3 |
| | PLAIN PAPER (THIN PAPER) | –59 | H | 449.2 |
| | | | M | 449.5 |
| | | | L | 449.8 |
| | COATED PAPER | ・・・ | ・・ | ・・・ |
| | HIGH-QUALITY PAPER | ・・・ | ・・ | ・・・ |
| | ・・・ | ・・・ | ・・ | ・・・ |
| A3S | ・・・ | ・・・ | ・・ | ・・・ |
| | ・・・ | ・・・ | ・・ | ・・・ |
| ・・・ | ・・・ | ・・・ | ・・ | ・・・ |
| ・・・ | ・・・ | ・・・ | ・・ | ・・・ |

PAPER FEED DEVICE, IMAGE FORMATION SYSTEM, AND CONTROL PROGRAM FOR PAPER FEED DEVICE

The entire disclosure of Japanese patent Application No. 2021-094950, filed on Jun. 7, 2021, is incorporated herein by reference in its entirety.

BACKGROUND

Technological Field

The present invention relates to a paper feed device, an image formation system, and a control program for the paper feed device.

Description of the Related Art

A paper feed device is used in an image formation device. The paper feed device loads and stores paper on a paper feed tray, feeds the sheets of paper one by one from the loaded stack of paper (referred to as a paper stack), and sends the paper to the image formation device.

The paper feed tray has regulation plates for aligning edges of the loaded paper. The regulation plates are in contact with respective edge surfaces of four sides of the paper to regulate a paper feed direction and a position of an entire paper stack in a direction orthogonal to the paper feed direction (width direction). In order to support various paper sizes, the regulation plates are provided such that an interval between one regulation plate and another facing regulation plate (referred to as an interval between regulation plates) can be changed.

An interval between regulation plates affect paper feed performance. For example, in a case where an interval between regulation plates is narrower than an appropriate range, excessive load may be applied to the paper at a time of paper feed. Accordingly, the paper may be folded or not be fed, or paper may be separated from the paper stack, causing a paper feed failure or conveyance failure (including conveyance stop). Conversely, in a case where the interval between the regulation plates is wider than the appropriate range, the loaded paper may be inclined or a position thereof may be deviated, causing a defective image with image bending, image shift, or the like.

Some among conventional paper feed devices include regulation plates of which operation is motorized. In such a paper feed device, regulation plates are moved in directions of narrowing intervals between regulation plates at a timing when paper is set on a paper feed tray, and the regulation plates are stopped when a drive torque of the regulation plates reaches a predetermined value. Accordingly, the conventional paper feed devices can automatically eliminate a gap between a regulation plate and a paper edge, enabling positioning of regulation plates at positions corresponding to various paper sizes.

Patent Literature 1: JP H11-292305 A

However, there has been a problem that, even if the paper sizes are the same, normal paper feed at the same positions of the regulation plates cannot be achieved depending on a type or state of paper, causing a paper feed failure, a conveyance failure, a defective image, or the like.

SUMMARY

Therefore, an object of the present invention is to provide a paper feed device capable of moving regulation plates to positions suitable for a paper characteristic, an image formation system including the paper feed device, and a control program for the paper feed device.

To achieve the abovementioned object, according to an aspect of the present invention, a paper feed device having regulation plates that are movable on a paper feed tray for loading paper and regulate edges of the paper, reflecting one aspect of the present invention comprises: a driver that moves the regulation plates; and a hardware processor that acquires paper information corresponding to a characteristic of the loaded paper, and causes the driver to move the regulation plates according to the acquired paper information.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention:

FIGS. 3A and 3B are explanatory diagrams for describing a configuration of a roller-type paper feed tray, in which FIG. 3A is a side view of the paper feed tray, and FIG. 3B is a top view of the paper feed tray;

FIG. 9 is an example of a determination table illustrating a correspondence between paper characteristics and proper regulation plate positions;

FIG. 11 is a diagram illustrating an example of a determination table illustrating a correspondence between paper profiles and proper regulation plate positions;

FIG. 16 is an example of jam history;

FIG. 19 is an explanatory diagram for describing an example of updating the determination table;

DETAILED DESCRIPTION OF EMBODIMENTS

Figure 1:
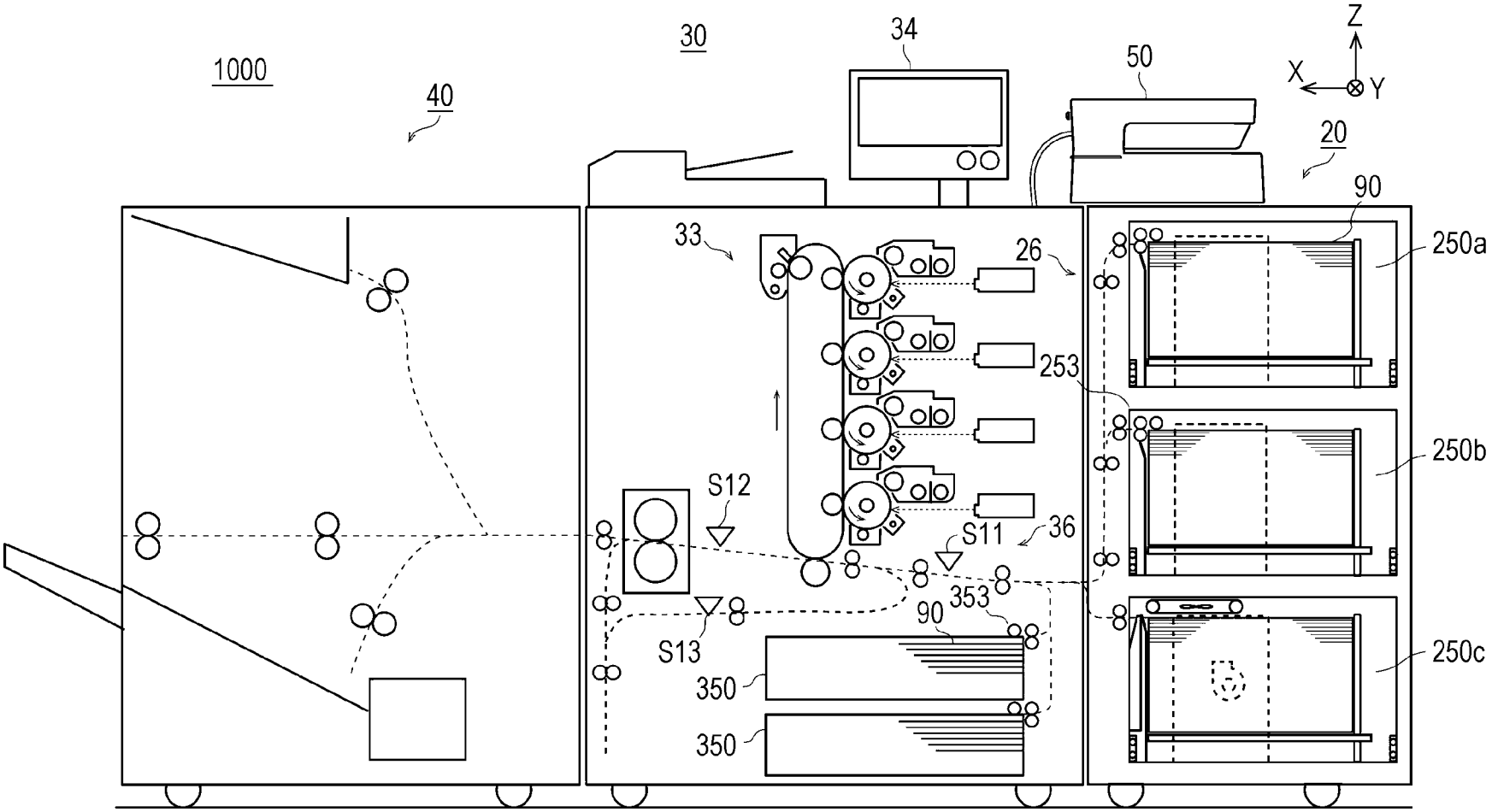
FIG. 1 is a schematic configuration diagram of an image formation system.

Hereinafter, one or more embodiments of the present invention will be described with reference to the drawings. However, the scope of the invention is not limited to the disclosed embodiments. In description of the drawings, the same or corresponding components are denoted by the same reference signs, and redundant description thereof is omitted. In addition, dimension ratios in the drawings are exaggerated for convenience of description, and may be different from actual ratios. In the drawings, a Z direction represents a vertical direction, a Y direction represents a front-surface to back-surface direction of an image formation system, and an X direction represents a direction orthogonal to the Y and Z directions. In the following description, the X direction may be referred to as a conveyance direction (feed direction: FD) of paper, and the Y direction intersecting the conveyance direction may be referred to as a width direction (cross direction: CD) of the paper. In the present embodiment, the "paper" includes print paper and various kinds of film. In particular, the print paper includes paper produced by using plant-derived mechanical pulp and/or chemical pulp. In addition, the paper types include gloss paper (also referred to as coated paper), matte paper, plain paper, high-quality paper, high-gloss paper, and the like.

First Embodiment

A basic embodiment according to the present invention will be described.

(Image Formation System)

Figure 2:
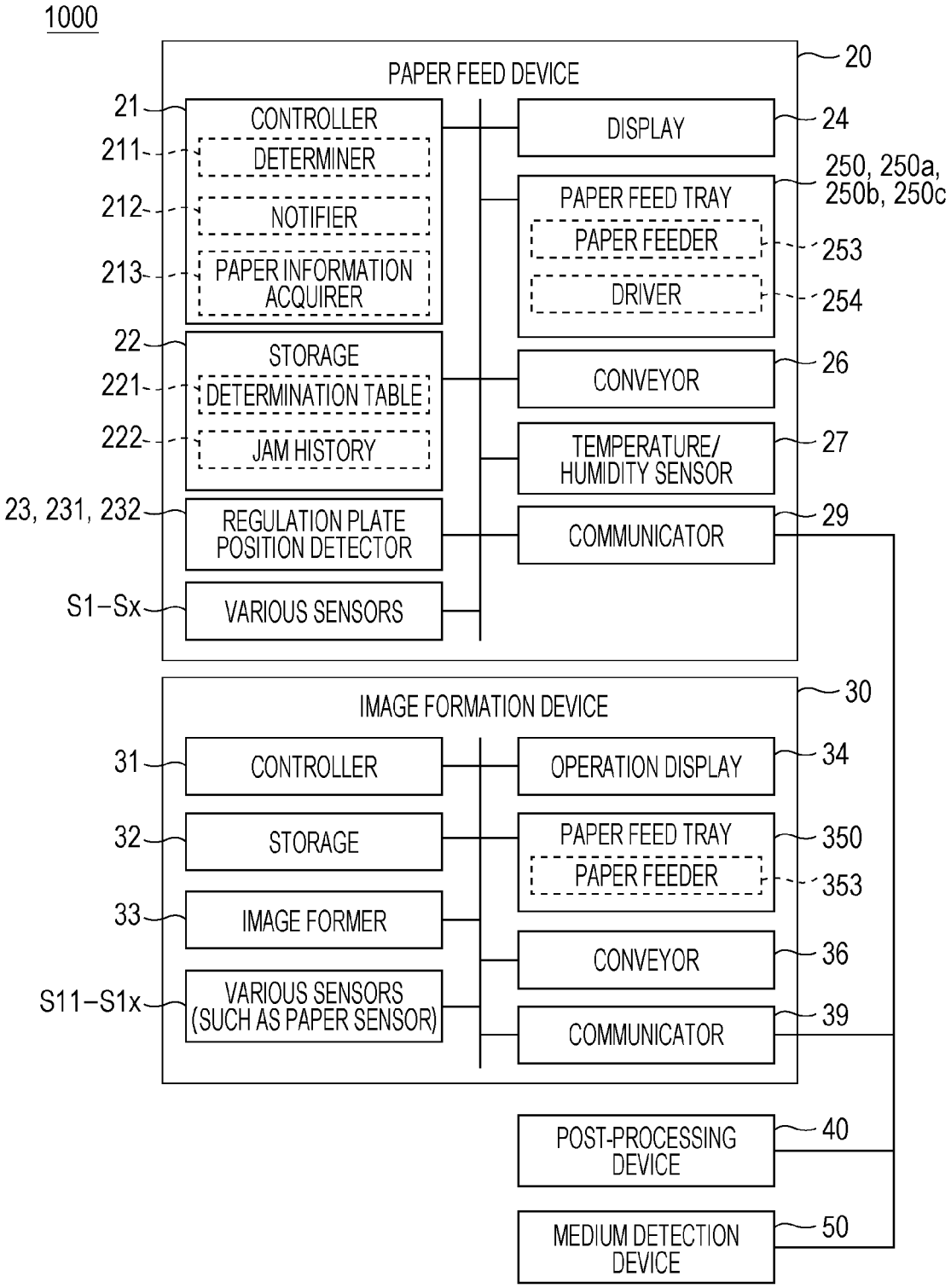
FIG. 2 is a block diagram of the image formation system.

FIG. 1 is a schematic configuration diagram of an image formation system 1000, and FIG. 2 is a block diagram of the image formation system 1000.

As illustrated in FIG. 1, the image formation system 1000 includes a paper feed device 20, an image formation device 30, a post-processing device 40, and an external medium detection device 50. The paper feed device 20, the image formation device 30, and the post-processing device 40 are connected in that order along a conveyance direction of paper 90.

(Paper Feed Device)

As illustrated in FIG. 1, the paper feed device 20 includes a plurality of paper feed trays 250*a*, 250*b*, and 250*c*. Each of the paper feed trays 250*a*, 250*b*, and 250*c* includes regulation plates that regulate four sides of the loaded paper 90 (also referred to as a paper stack). Hereinafter, the paper feed trays 250*a*, 250*b*, and 250*c* are also referred to as a paper feed tray 250 in a case where they are collectively referred to, or are not distinguished from each other.

The paper feed tray 250*a* is a paper feed tray 250 of a roller-conveyance type that feeds and conveys uppermost sheets of paper 90 in the paper stack one by one by separating rollers.

The paper feed tray 250*b* is a roller-conveyance type paper feed tray 250 having the same configuration as the paper feed tray 250*a*.

The paper feed tray 250*c* is an air-conveyance type paper feed tray 250, and separates an uppermost sheet of the paper 90 from the paper stack with airflow formed by a fan, and feeds the paper 90 separated by a suction belt having negative pressure inside and a plurality of small holes.

Details of these paper feed trays 250 will be described later. Note that the configuration of the paper feed trays 250 illustrated in FIG. 1 and the like is merely an example, and the paper feed device 20 can include any number of paper feed trays 250 of the roller-conveyance type or the air-conveyance type.

As illustrated in FIG. 2, the paper feed device 20 includes a controller 21, a storage 22, a regulation plate position detector 23, various sensors S1 to Sx, a display 24, the paper feed tray 250, a conveyor 26, a temperature/humidity sensor 27, a driver 28, and a communicator 29 as a configuration for control.

(Controller)

The controller 21 includes a central processing unit (CPU) and a memory. The CPU is a control circuit including a multi-core processor or the like that controls each of the above-described units or various kinds of arithmetic processing according to a program. Each function of the paper feed device 20 is exerted by the CPU executing a program corresponding thereto. The memory is a main storage device that can be accessed at high speed and, as a work area, temporarily stores a program or data. The memory is, for example, a dynamic random access memory (DRAM), a synchronous dynamic random access memory (SDRAM), a static random access memory (SRAM), or the like. In addition, a read only memory (ROM) is used as a memory for persistent storage of some programs and data.

The controller 21 controls an entire paper feed device 20. The controller 21 causes the driver 254 to move regulation plates (to be described later) according to paper information acquired by a paper information acquirer 213. The paper information acquirer 213 cooperates with the medium detection device 50 to acquire paper information corresponding to a characteristic of the paper 90. Furthermore, the paper information acquirer 213 acquires paper information corresponding to the characteristic of the paper 90 from a paper profile input from an operation display 34 or a paper profile transmitted via the communicator 29.

The controller 21 functions as a notifier 212 in cooperation with the communicator 29, the display 24, the operation display 34, or the like. The function of the notifier 212 is, for example, display of paper information, display of a jam determination result, error display or warning display for when movement of the regulation plates to positions based on the paper information cannot be completed, or the like. Note that such a notification may be not only displayed, but also emitted as sound by a speaker (not illustrated) or emitted as warning sound.

Note that the controller 21 of the paper feed device 20 may be provided alone in the paper feed device 20, or a controller (referred to as an image formation controller 31) of the image formation device 30 may control the paper feed device 20. In such a case, the image formation controller 31 of the image formation device 30 also serves as the controller 21 of the paper feed device 20.

The storage 22 is a large-capacity auxiliary storage device that stores various programs including an operating system, and various data. As the storage 22, for example, a hard disk, a solid-state drive, a flash memory, or the like is adopted. The storage 22 stores a determination table 221 for moving the regulation plates to proper positions, and data of jam history 222 in which jam occurrence information is accumulated.

The various sensors S1 to Sx include optical sensors (sensors S2 and S5 (in FIGS. 3A, 3B, and 4 to be described later)) that detect presence or absence of the paper 90 conveyed in a conveyance path or the like, and sensors (sensors S1, S3, and S4 (in FIGS. 3A, 3B, and 4 to be described later)) that are combinations of an optical sensor and an actuator. Each of these sensors functions as a jam information acquirer that acquires jam information indicating an occurrence of a jam of the paper 90 at a time of paper feed or paper conveyance.

The display 24 is, for example, an LED or a liquid crystal display, and is provided on an upper portion of a main body of the paper feed device 20 or a front panel of each paper feed trays 250. For example, in a case where the display 24 includes an LED, color of the LED is changed, or a plurality of LEDs is turned on or off as appropriate, by which the display 24 indicates to a user that positions of the regulation plates fall (or are changed to fall) within an appropriate range, or that the positions of the regulation plates are (or are changed to be) out of the appropriate range. Note that the display 24 may not be provided on the main body of the paper feed device 20, and, instead, the operation display 34 of the image formation device 30 may also serve as the display 24.

(Paper Feed Tray)

Figure 3A:
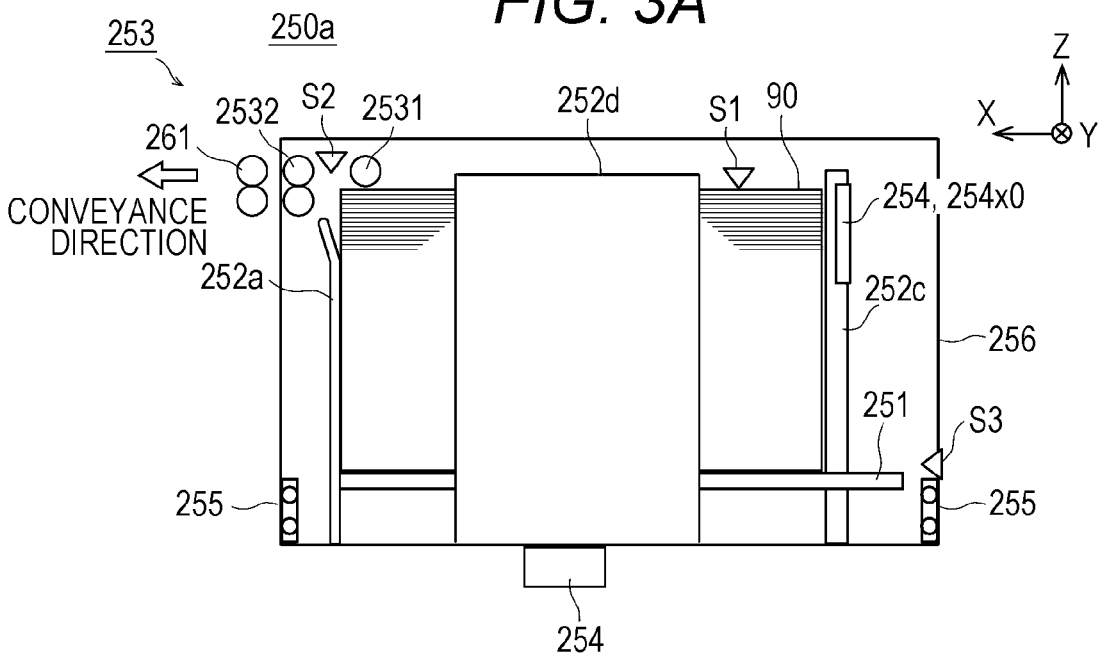
Figure 3B:
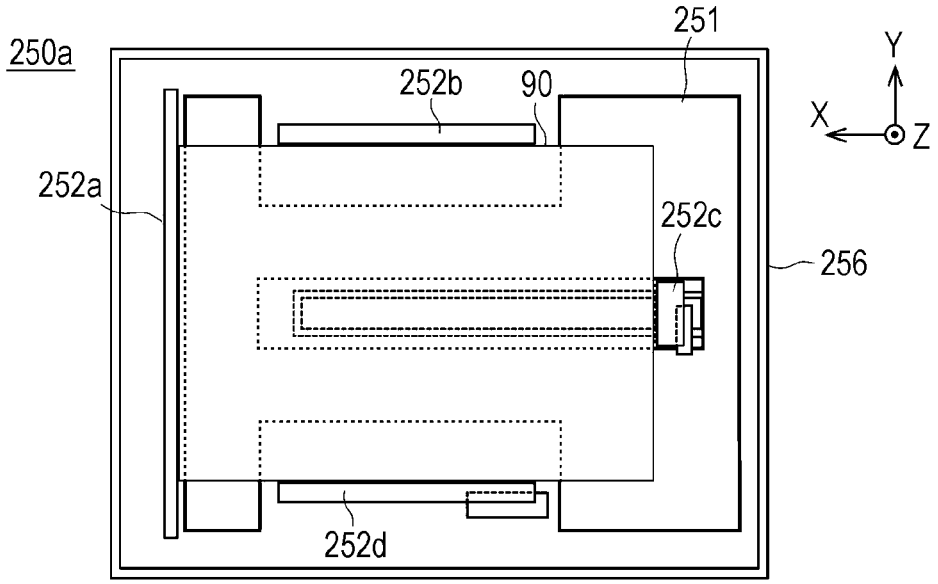

FIGS. 3A and 3B are explanatory diagrams for describing a configuration of the roller-type paper feed tray 250*a*. FIG. 3A is a side view of the paper feed tray 250*a*, and FIG. 3B is a top view of the paper feed tray 250*a*. Note that a configuration of the paper feed tray 250*b* is the same as a configuration of the paper feed tray 250*a*, and description thereof is omitted.

As illustrated in FIGS. 3A and 3B, the paper feed tray 250*a* includes a placing plate 251 on which a paper stack of the loaded paper 90 is placed, regulation plates 252*a* to 252*d* that regulate four side edges (four sides) of the paper stack on the placing plate 251, a paper feeder 253, the driver 254, a pair of left and right slide rails 255, and a housing 256. Hereinafter, the regulation plates 252*a* to 252*d* are also referred to as a regulation plate 252 in a case where they are collectively referred to, or are not distinguished from each other.

The placing plate 251 moves up and down by a lifting mechanism (not illustrated) including a wire, a pulley, a motor, an encoder, or the like, while staying horizontal. The lifting mechanism detects height of the placing plate 251. A sensor S1 detects an uppermost sheet of the paper 90 in the paper stack placed on the placing plate 251 reaching a predetermined position. The sensor S1 turns on when an upper surface of the paper stack reaches a predetermined height. At a time of paper feed, the controller 21 controls the lifting mechanism according to output by the sensor S1 so that height of the uppermost sheet of the paper 90 in the paper stack is at the predetermined position. The controller 21 may also determine a remaining amount of paper from the height of the placing plate 251.

The paper feeder 253 includes a pickup roller 2531 and a pair of separating rollers 2532 downstream of the pickup roller 2531. The separating rollers 2532 convey the paper 90 sent out in the conveyance direction by the pickup roller 2531 to conveyance rollers 261 of the conveyor 26 on a downstream side. A lower roller of the separating rollers 2532 rotates in a direction opposite to a direction in which an upper roller of the separating rollers 2532 rotates within a range of torque equal to or less than a predetermined value by a torque limiter, such that the paper 90 is sent. The lower roller of the separating rollers 2532 has a function to separate a second and lower sheets of the paper 90 from a first uppermost sheet of the paper 90 when the pickup roller 2531 sends out two or more sheets of the paper 90, thereby preventing double feeding.

Each of the paper feed trays 250 is supported by a pair of left and right slide rails 255 extending in the Y direction so as to be drawable from a main body of the paper feed device 20. A sensor S3 detects the paper feed tray 250 being drawn or being loaded in the main body of the paper feed device 20. In addition, power is supplied to the regulation plate position detector 23 even in a state where the paper feed tray 250 is drawn (a state where the paper feed tray 250 is not completely removed from the main body), and positions of the regulation plates 252 can be detected.

Figure 4:
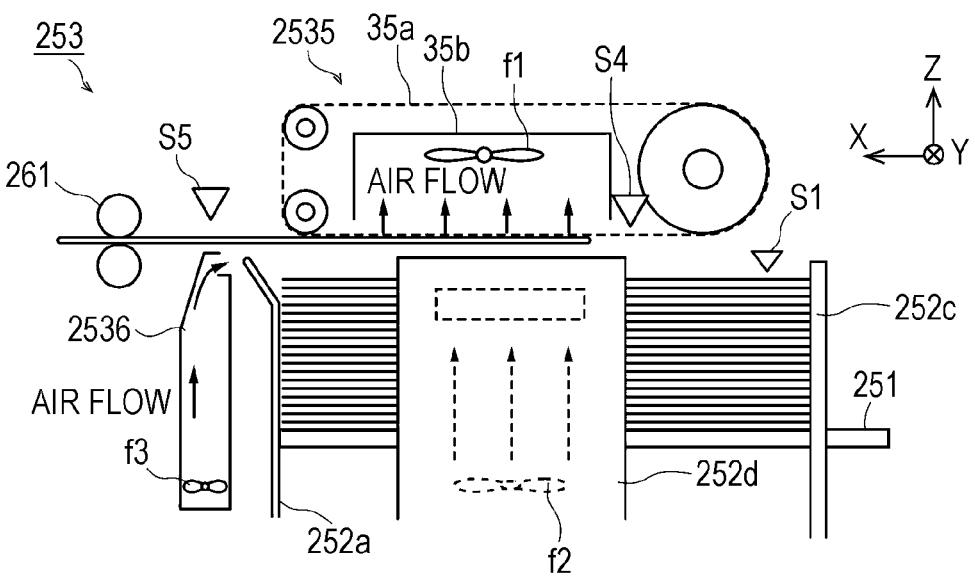
FIG. 4 is a side view for describing an air-conveyance type paper feed tray.

Next, the air-conveyance type paper feed tray 250*c* will be described. FIG. 4 is a side view for describing the air-conveyance type paper feed tray 250*c*.

As illustrated in FIG. 4, the paper feeder 253 of the paper feed tray 250*c* includes a suction unit 2535, a leading-edge blower 2536, and fans f1, f2, and f3 as air pressure generators. In the suction unit 2535, three paper feed belts 35*a* are arranged in parallel in the width direction, and these endless paper feed belts 35*a* are wound around a plurality of rollers connected to a drive motor (not illustrated) and are rotatably supported. The paper feed belts 35*a* are provided with a large number of small-diameter through holes, and a duct 35*b* is disposed inside each of the through holes. A suction port facing the paper feed belts 35*a* is provided below the duct 35*b*, and an inside of each of the paper feed belts 35*a* is subjected to negative pressure by a suction fan f1. Air sucked by the suction fan f1 is exhausted to a back surface side of the device via the duct 35*b*.

The suction fan f1 always operates during image formation (during paper feed operation), and the suction unit 2535 sucks, with the paper feed belts 35*a*, an uppermost sheet of the paper 90 blown upward from the paper stack by air blowing described later. A sensor S4 detects, with an ON signal, the paper 90 having been sucked onto a surface of a paper feed belt 35*a*. Therefore, the sensor S4 is also referred to as a suction sensor. The controller 21 starts the operation of the drive motor in response to the ON signal (paper suction OK) of the sensor S4, and rotates the paper feed belts 35*a*. The paper 90 sucked onto the front surface is conveyed to a downstream side (X direction) in a paper conveyance direction according to the rotation, and is fed toward the conveyance path. By a sensor S5 disposed on the downstream side of the paper feed belts 35*a* outputting the ON signal, a controller 110 judges that the paper 90 is normally conveyed and starts driving the conveyance rollers 261 at a predetermined timing.

Respective blowing fans f2 disposed on both sides in the width direction blow air for separation from an opening (indicated by a dashed-line rectangle in FIG. 4) to an upper side surface of the paper stack via a duct integrally formed with the regulation plate 252*d* (252*b*). Accordingly, at a time of paper feed, the blowing fans f2 separate an uppermost sheet of the paper 90 from the paper stack and allow the sheet to be easily sucked to the suction unit 2535. A plurality of sheets of the paper 90 may be blown upward from the paper stack by air blowing through the opening by the blowing fans f2. The leading-edge blower 2536 has a function of separating sheets of the paper 90 other than the uppermost sheet sucked onto the paper feed belts 35*a*. Specifically, a blowing fan 0 of the leading-edge blower 2536 blows air toward an upstream side via the opening. Thus, among the plurality of sheets of the paper 90 blown upward, the sheets of the paper 90 other than the uppermost sheet are separated.

(Regulation Plates and Regulation Plate Driver)

Figure 5:
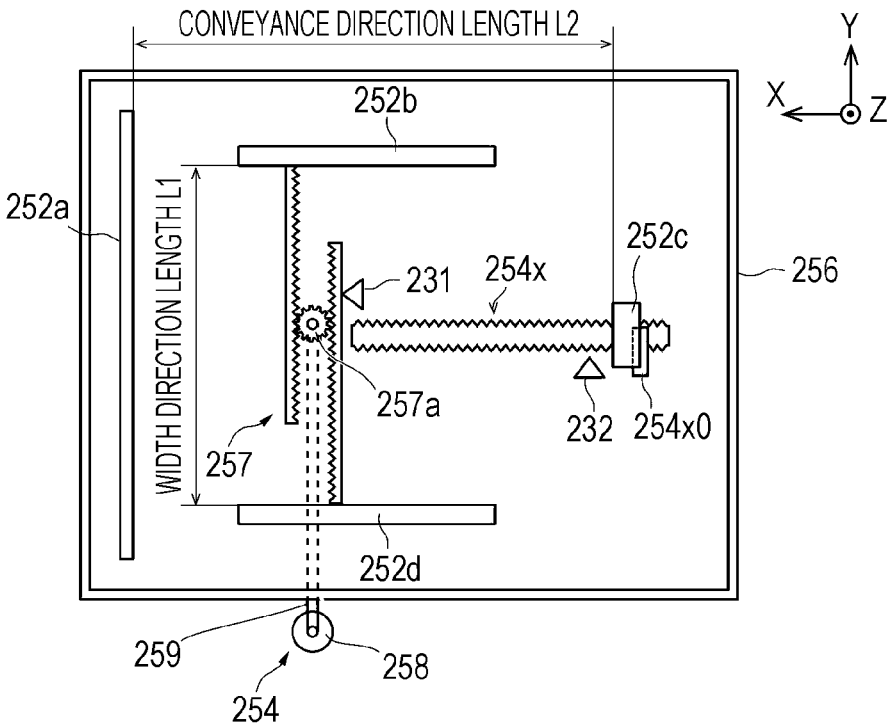
FIG. 5 is a schematic diagram illustrating an internal configuration of the paper feed tray.

FIG. 5 is a schematic diagram illustrating an internal configuration of the paper feed tray 250. In FIG. 5, the placing plate 251 and paper 90 are omitted.

Among the regulation plates 252*a* to 252*d*, a regulation plate 252*a* on the downstream side in the conveyance direction is fixedly disposed in the housing 256. Meanwhile, the regulation plates 252*b* to 252*d* are held so as to be movable with respect to the housing 256 in order to correspond to various paper sizes. In particular, the regulation plates 252*b* to 252*d* are held so as to be movable by the driver 254 with respect to the housing 256.

A configuration of the regulation plates 252*a* to 252*d* and a configuration of the driver 254 are the same for the roller-type paper feed trays 250*a* and 250*b* and the air-conveyance type paper feed tray 250*c*.

The regulation plates 252*b* and 252*d* to be in contact with both edge surfaces in the width direction of the paper 90 are provided so as to be movable in a direction perpendicular to the paper feed direction, and an interval between the regulation plates can be changed.

The regulation plates 252*b* and 252*d* are a pair of regulation plates, and are held so as to be movable by the driver 254. The regulation plates 252*b* and 252*d* regulate side edge surfaces (hereinafter referred to as edge surfaces) in the width direction of the paper (paper stack). The driver 254 includes a rack and pinion 257 (which may include another gear mechanism), a motor 258, and a belt and pulley 259 for transmitting driving force of the motor 258 to a pinion gear 258*a*. The driver 254 moves a pair of regulation plates 252*b* and 252*d* to positions facing each other and away from a central position by the same distance in the width direction. The controller 21 rotates the motor 258 to move the positions of the regulation plates 252*b* and 252*d*.

The user draws the paper feed tray 250*a* from the main body of the paper feed device 20 forward, and then places the paper stack on the placing plate 251. At this time, the regulation plates 252*b* and 252*d* can be moved to arbitrary positions by the user. In addition, if a paper size has been input in advance before the user draws the paper feed tray 250*a*, the regulation plates 252*b* and 252*d* are moved to positions corresponding thereto according to a command from the controller 21.

After the paper stack is set, the controller 21 controls the regulation plates 252*b* and 252*d* to further move to maintain an appropriate position of the paper stack. The control of the regulation plates 252*b* and 252*d* after the paper stack setting will be described later.

(Regulation Plate Position Detector)

A regulation plate position detector 231 includes an optical sensor, a mechanical sensor, or the like. For example, in a case of the optical sensor, a line image sensor (or an area image sensor) or the like may be disposed in vicinity of a regulation plate 252 to detect a position of the regulation plate 252. In a case of the mechanical sensor, a position of a regulation plate 252 can be detected by converting movement of a rack or the like connected to the regulation plate 252 into a rotation amount of a pinion gear or the like.

A gap between inner surfaces of the regulation plates 252*b* and 252*d*, that is, a length L1 in the width direction (hereinafter, also referred to as a regulation plate position) is detected by detecting a movement position of the regulation plate 252*b* and/or 252*d* in the Y direction (a position where the regulation plate has stopped after the movement). Position information of the detected regulation plates 252*b* and 252*d* is stored in the storage 22.

Similarly, in the conveyance direction, a regulation plate position detector 232 is provided to detect a position of the regulation plate 252*c*. Position information of the detected regulation plate 252*c* is stored in the storage 22. Position of the regulation plate 252*c* is manually movable by a position adjustment member 254*x*. The position adjustment member 254*x* includes a gear rack (or a slide bar), a lock groove, and the like. When a gripping member 254*x*0 attached to the position adjustment member 254*x* is pressed by the user, the position adjustment member 254*x* is unlocked to allow the regulation plate 252*c* to move. The user moves the regulation plate 252*c* to a position where the regulation plate 252*c* abuts against a rear edge of the paper stack in the conveyance direction, and then returns the gripping member 254*x*0, by which the regulation plate 252*c* is fixed to the housing 256.

Note that the position of the regulation plate 252*c* may not be as exact as the paper width direction regulated by the regulation plates 252*b* and 252*d*. Paper position in the paper conveyance direction (especially, a position of a leading edge of the paper 90) is positioned by a registration roller or the like in the image formation device 30. Therefore, the paper position in the conveyance direction in the paper feed device 20 is only required to be regulated to a position that does not interfere with paper feed. Of course, the driver 254 may be provided to move the regulation plate 252*c*, and the regulation plate 252*c* may be moved under control of the controller 21.

Similarly, the regulation plate position detector 232 includes an optical sensor, a mechanical sensor, or the like, and can detect a gap between inner surfaces of the facing regulation plates 252*a* and 252*c*, that is, a length L2 in the conveyance direction, by detecting an adjustment position of the regulation plate 252*c* in the X direction.

Resolution (minimum detector) of the regulation plate position detectors 231 and 232 is, for example, 0.1 mm or 0.05 mm.

(Conveyor)

The conveyor 26 includes a plurality of conveyance rollers (conveyance rollers 261 or the like) and a drive motor (not illustrated) disposed on a conveyance path, and conveys the paper 90 fed from each paper feed tray 250 of the paper feed device 20 to the image formation device 30 via the conveyance path in the paper feed device 20.

(Temperature/Humidity Sensor)

The temperature/humidity sensor 27 is an environment detector. The temperature/humidity sensor 27 detects temperature and humidity outside the paper feed device 20. The environment detector may be a temperature sensor or a humidity sensor that detects only temperature or only humidity. The environment detector may detect temperature and/or humidity inside the paper feed device 20.

(Communicator)

The communicator 29 is an interface for communicating with another device such as the image formation device 30. To and from the image formation device 30 or the like, the communicator 29 transmits and receives various setting values, various types of information necessary for operation timing control, and the like. In addition, the communicator 29 transmits paper information from the image formation device 30 and the medium detection device 50 to the paper information acquirer 213.

(Image Formation Device 30)

Refer to FIGS. 1 and 2 again. The image formation device 30 includes the image formation controller 31, a storage 32, an image former 33, various sensors S11 to S1*x*, the operation display 34, a paper feed tray 350, a conveyor 36, and a communicator 39.

Among these, the image formation controller 31, the storage 32, the paper feed tray 350 (paper feeder 353), the conveyor 36, and the communicator 39 have configurations corresponding to configurations of the controller 21, storage 22, paper feed tray 250*a* (paper feeder 253), conveyor 26, and communicator 29 in the above-described paper feed device 20, respectively. Therefore, description thereof is omitted.

The image former 33 forms an image on the paper 90 conveyed from the paper feed device 20, or on the paper 90 fed and conveyed from the paper feed tray 350 of the self-device. The image former 33 forms an image on the paper 90 by using a well-known electrophotographic image forming process including each step of, for example, charging, exposure, development, transfer, and fixing.

The sensors S11 to S13 disposed on the conveyance path are optical sensors similarly to the sensor S2, and detect conveyance of the paper 90. Note that, in FIG. 1, only the sensors S11 to S13 are displayed as a representative example. In this regard, a greater number of sensors S1*x* may be disposed on the conveyance path. Each of the sensors S11 to S1*x* detects presence or absence of the paper 90 on the conveyance path at an installed position, and sends a detection result to the image formation controller 31. In a case where the paper 90 is present or absent at a detection position of each of the sensors S11 to S1*x* at a predetermined timing, the image formation controller 31 judges that a jam such as a paper feed failure or a conveyance failure has occurred. In the present embodiment, a case where conveyance of paper (image forming operation) is stopped in response to a stop instruction from the user is also regarded as occurrence of a jam (described later).

Jam information indicating occurrence of a jam is transmitted to the controller 21 via the communicator 39 and the communicator 29, and is stored in the storage 22 as jam history 222. The jam information is conveyance stop occurrence information, and the storage 22 that stores the jam history 222 serves as an event information storage.

Note that some of the sensors S1 to S1*x* may include line image sensors, and may continuously detect positions of edges of the conveyed paper 90 to detect skew feeding or deviation of the paper 90. Skew feeding or deviation of the paper 90 in the image formation device can be detected by using a line image sensor as the sensor S11. The line image sensor is, for example, a contact image sensor (CIS) or the like, and is an image sensor that reads a one-dimensional image by arranging photoelectric conversion elements in one line or a plurality of lines.

The operation display 34 includes a touch panel, numeric keys, a start button, a stop button, and the like, and is used to display various information and input various instructions. Via the operation display 34, the user can input paper information such as a size, type, paper profile of the paper 90 stored in each paper feed tray 250. The image formation controller 31 stores, in the storage 22, the paper information input by the user. In the present embodiment, paper information input from the operation display 34 is also used in the controller 21 of the paper feed device 20. Therefore, in the paper feed device 20, the operation display 34 serves as an inputter that receives input from the user. In a case where there is a defect in an image formed on the paper 90, the user inputs stop (halfway stop) of printing (image formation) from the operation display 34. When such a halfway stop is input, the image formation controller 31 transmits the input of the halfway stop to the controller 21 as an aspect of a jam. The controller 21 having received the notification causes the storage 22 to store the halfway stop as jam history 222.

In a case of an irregular paper size, the paper size is set by the user inputting the size by using the numeric keys on the operation display 34. A regular paper size may be similarly input by the user. Alternatively, the image formation controller 31 may automatically set a regular size that matches a combination of lengths in the vertical direction (conveyance direction) and horizontal direction (CD) calculated from the respective positions of the regulation plates 252, the lengths being detected by the regulation plate position detector 23.

(Post-Processing Device)

The post-processing device 40 includes a post-processor, the conveyance path, and a paper ejection tray. The post-processor performs processing such as stapling processing, cutting processing, or punching processing (punched hole) on the paper 90 conveyed from the image formation device 30. In addition to the components described above, the post-processing device 40 includes a controller, a storage, and a communicator (all not illustrated) that are connected to one another via a signal line, such as a bus, for exchanging signals.

(Medium Detection Device)

The medium detection device 50 is a paper information detector. The medium detection device 50 detects paper information corresponding to a characteristic of the paper 90 in cooperation with the paper information acquirer 213. The paper information is, for example, at least one characteristic selected from among groups of paper type of the paper 90, basis weight of the paper 90, moisture content of the paper 90, charging rate of the paper 90, and smoothness of the paper 90. Therefore, the medium detection device 50 includes a paper thickness detector, a basis weight detector, a surface property detector, and a moisture content detector (all not illustrated). In the medium detection device 50, the paper 90 is inserted into a paper passing area of the device, and a characteristic of the paper 90 is detected. The detected characteristic of the paper 90 is transmitted to the controller 21 as paper information.

In the example illustrated in FIG. 1, in the paper feed device 20, the medium detection device 50 is disposed above a position of the loaded paper 90. However, disposition of the medium detection device 50 is not limited thereto, and for example, the medium detection device 50 may be a built-in type device configured to use the conveyance path of the image formation device 30 as a measurement area. Alternatively, the medium detection device 50 may be an external device disposed separately from the paper feed device 20.

The paper thickness detector includes a pair of conveyance rollers and a measure. At least either one of the conveyance rollers is movable according to thickness of the paper 90 passing through a nip. The measure measures a distance between shafts of the pair of the conveyance rollers. The measure includes, for example, an actuator, an encoder, and a light emitter/receiver. The paper thickness detector stores a result of measuring thickness of the paper 90 (measurement value 1) in the storage 22.

The basis weight detector is a sensor that detects basis weight of the paper 90, includes a light emitter and a light receiver, and measures the basis weight according to an amount of attenuation of light transmitted through the paper 90. For example, the light emitter of the basis weight sensor is disposed below the paper passing area (paper passage) into which the paper 90 is inserted, and the light receiver of the basis weight sensor is disposed above the paper passing area. The basis weight sensor detects the basis weight of the paper 90 with intensity of light received by the light receiver when the paper 90 is caused to pass between the light emitter and the light receiver, and stores a measurement result (measurement value 2) in the storage 22.

The surface property detector includes a housing, a light emitter, a collimator lens, and a plurality of light receivers, and optically detects regular reflection light and diffuse reflection light from a paper surface as described below. A guide plate above the paper passing area is provided with an opening (measurement area), and the opening serves as an irradiation area of the light receiver. The paper 90 inserted up to the opening is pressed by a pressing mechanism lifted from below the paper passing area. In this state, irradiation light made substantially parallel by the collimator lens is emitted from the light emitter at an incident angle of 75° with respect to a reference plane. A wavelength of the irradiation light is, for example, 465 nm. The plurality of light receivers receives regular reflection light and diffuse reflection light. For example, the light receivers are disposed at three places at a reflection angle of 30 degrees (for diffuse reflection light), 60 degrees (for diffuse reflection light), and 75 degrees (for regular reflection light), or two places at 60 degrees and 75 degrees. The surface property detector stores a signal of the light receiver in the storage 22 as a result of measuring the paper characteristic (measurement value 3).

The moisture content detector includes, for example, a near-infrared light type moisture content sensor that optically detects a light absorption amount of an OH group. The moisture content sensor utilizes a property of an absorption rate of light that changes according to a moisture content of the paper 90 on which light of a predetermined wavelength in the near-infrared region is emitted. In addition, as another example of the measurement of the moisture content, the moisture content may be measured by irradiating the paper 90 with light separated by a deflection filter and measuring change in a light amount of a reflection light component from inside of the paper 90. The moisture content detector stores, for example, the moisture content in the storage 22 as a result of measuring the paper characteristic.

The paper type and the basis weight are discriminated basically by using the result of paper characteristic measurement by the medium detection device 50 as described below. Alternatively, the user may manually input a paper type or basis weight through the operation display 34 or the like. In this case, the user can refer to and input information described on a package of the paper 90, for example.

The storage 32 of the image formation device 30 stores a model pre-trained by machine learning. The pre-trained model is used for paper type discrimination. This is a pre-trained model generated by supervised learning using training data, in which detection output of the paper 90 by the medium detection device 50 is an input value, and paper type information set by the user of the paper 90 is a ground truth label. For example, a paper type score of the paper type selected by the user is set to 1 (100%), and a paper type score of the paper type other than ground truth is set to 0 (0%).

The image formation controller 31 of the image formation device 30 obtains a basis weight conversion value, a paper thickness conversion value, and a surface property measurement value by using measurement results (measurement values 1 to 3) obtained by measuring the paper 90 by the paper thickness detector, basis weight detector, and surface property detector of the medium detection device 50.

As the basis weight conversion value, a basis weight and a basis weight difference (basis weight index value) are calculated from values of a first basis weight and a second basis weight with a coefficient and a calculation formula. The coefficient is determined by a surface property measurement value of the measurement value 3 and surrounding environment information (temperature, humidity (detected by the temperature/humidity sensor 27, for example)) of the image formation system 1000. Here, basis weight difference=first basis weight−second basis weight. The basis weight detector includes a plurality of LEDs that emits irradiation light having different wavelengths. The first basis weight is obtained by using a first LED that outputs irradiation light having a wavelength of 750 nm to 900 nm, and by determining transmission amount of the irradiation light transmitted through the paper 90. The second basis weight is obtained by using a second LED that outputs irradiation light having a wavelength of 400 nm to 470 nm, and by determining transmission amount of the irradiation light transmitted through the paper 90.

Regarding the paper type discrimination, the surface property measurement value, the basis weight difference, and density (=basis weight/paper thickness) are input by using a pre-trained model, and a "paper type score" of each candidate paper type is obtained as an output.

Basis weight division probability is calculated from the basis weight calculated as a basis weight conversion value. Examples of the basis weight divisions include the following five divisions. Note that the number of divisions and the range are merely examples, and more divisions, for example, 12 divisions in a range of less than 60 to 351 or more, may be used.

Less than 59 g/m$^2$,
60 g/m$^2$ to 90 g/m$^2$,
91 g/m$^2$ to 209 g/m$^2$,
210 g/m$^2$ to 256 g/m$^2$,
257 g/m$^2$ or more Assuming that the calculated basis weight varies with a predetermined standard deviation according to normal distribution, a probability (basis weight division probability) that calculated basis weight is included in each division is determined. For example, when the calculated basis weight is close to a mean of any of the divisions, probability that the basis weight obtained by measurement is included in the division is high and close to 100%. Meanwhile, the farther from the mean of the division, that is, the closer to a boundary of the division, the lower the probability. The basis weight division probability is output as a "basis weight division score".

Figure 6:
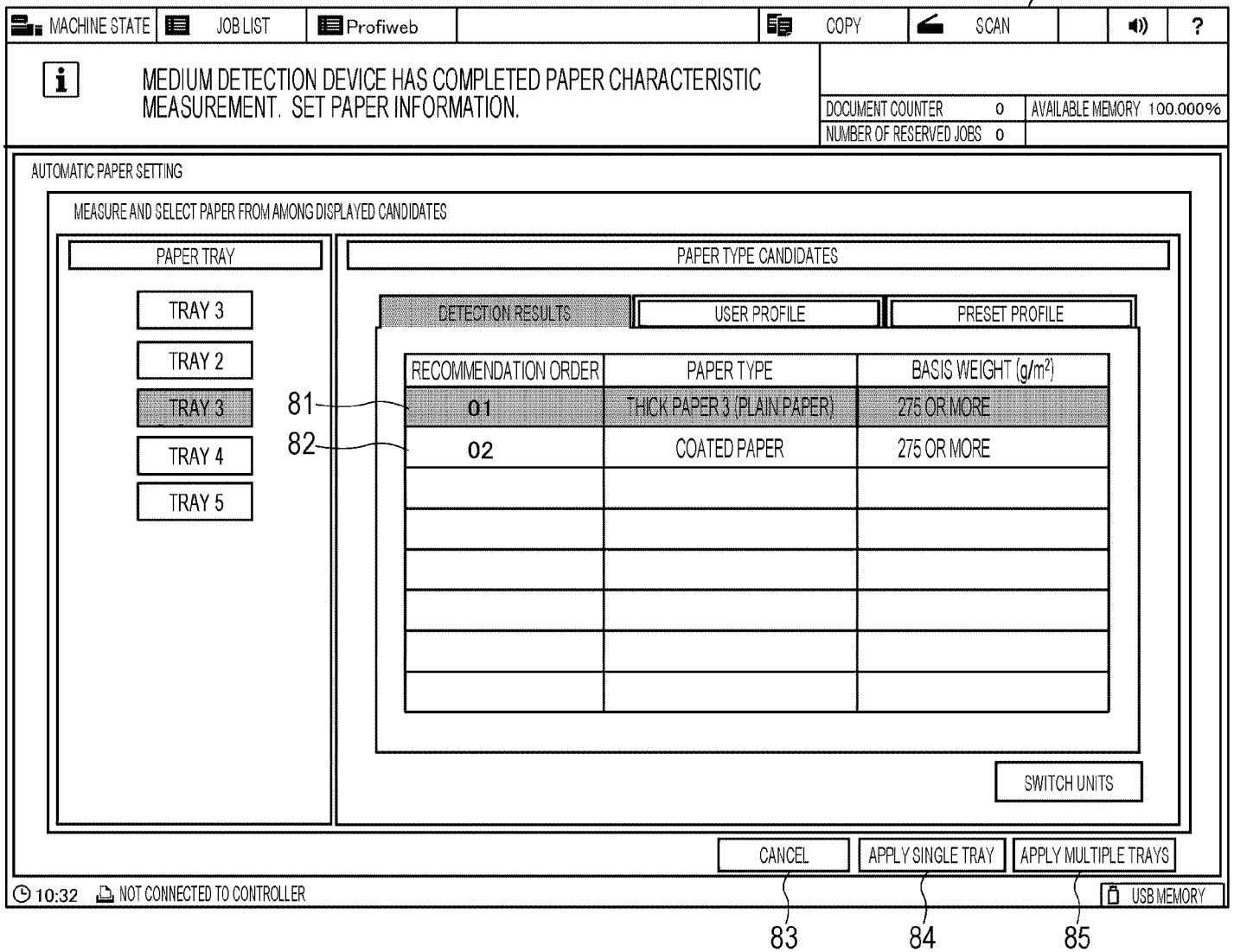
FIG. 6 is a screen example of an operation display on which a determination result (paper type/basis weight division) is displayed.

The image formation controller 31 displays one or a plurality of candidates of paper type/basis weight in descending order of probability according to the basis weight division score and the paper type score, and presents the candidates to the user. FIG. 6 is a screen example of an operation display on which a determination result (paper type/basis weight division) is displayed.

As illustrated in FIG. 6, on an operation screen 340 of the operation display 34, two candidates of the paper type/basis weight are displayed in descending order of the score of the paper type/basis weight division as the determination result. When accepting the determination result in a field 81 (plain paper/basis weight 301 to 350) as a first candidate, the user operates a button 84 to apply the determination result in the selected field 81 to a tray 3 (paper feed tray 250*a*). The applied determination result is stored in the storage 32. Note that, in a case where the determination result is related to the paper feed tray 250 of the paper feed device 20, the determination result may also be stored in the storage 22. In a case where a field 82 (coated paper/basis weight 301 to 350) as a second candidate is applied, the user selects the field 82 and then operates the button 84. Meanwhile, in a case where it is desired to apply the selected determination result to a plurality of paper feed trays 250 such as the trays 3 and 4, the user operates a button 85 after selecting the plurality of paper feed trays 250. Furthermore, the user can discard the determination result by operating a cancel button 83, without adopting the determination result. The determination result selected by the user may be accumulated in a cloud server or the like as ground-truth data and utilized as training data for subsequent machine learning.

(Position Control for Regulation Plates)

Figure 7:
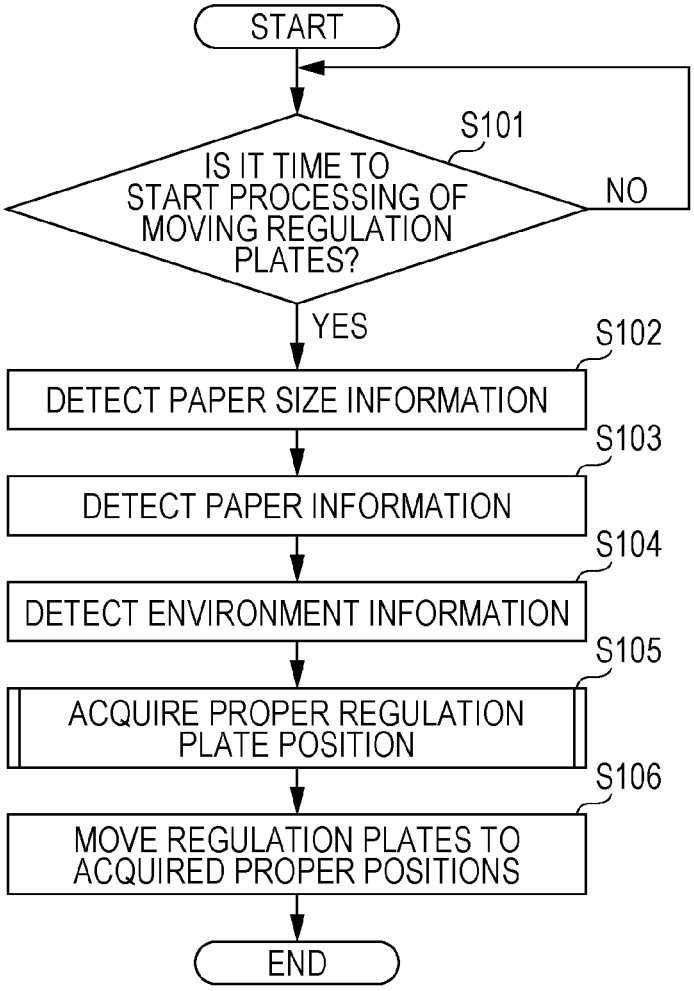
FIG. 7 is a flowchart illustrating a procedure for controlling movement of regulation plates.

Next, position control for the regulation plates will be described. FIG. 7 is a flowchart illustrating a procedure for controlling movement of the regulation plates. The position control for the regulation plates is performed by the controller 21 of the paper feed device 20 executing a program created according to the procedure described here. Here, the regulation plates 252*b* and 252*d* are controlled to proper positions according to a characteristic of the paper 90.

First, the controller 21 judges whether or not it is time to start processing of moving the regulation plates 252*b* and 252*d* (S101).

Figure 8A:
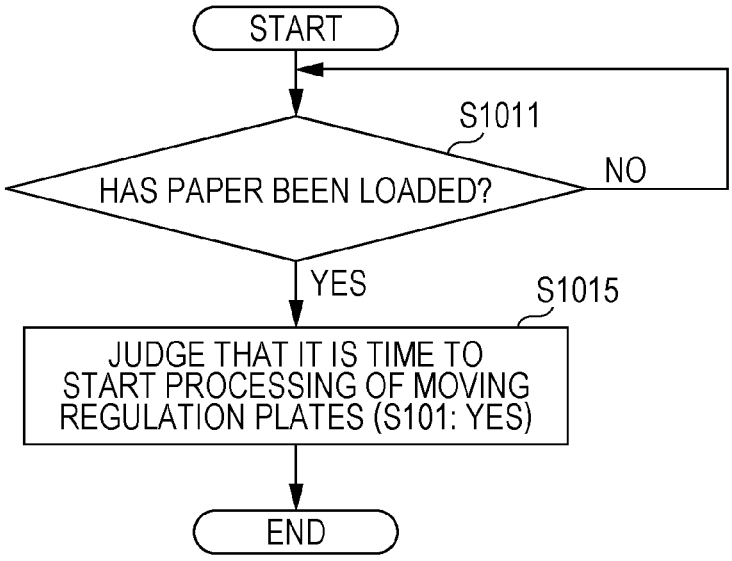
FIGS. 8A and 8B are flowcharts illustrating procedures for judging a regulation-plate movement processing start timing.
Figure 8B:
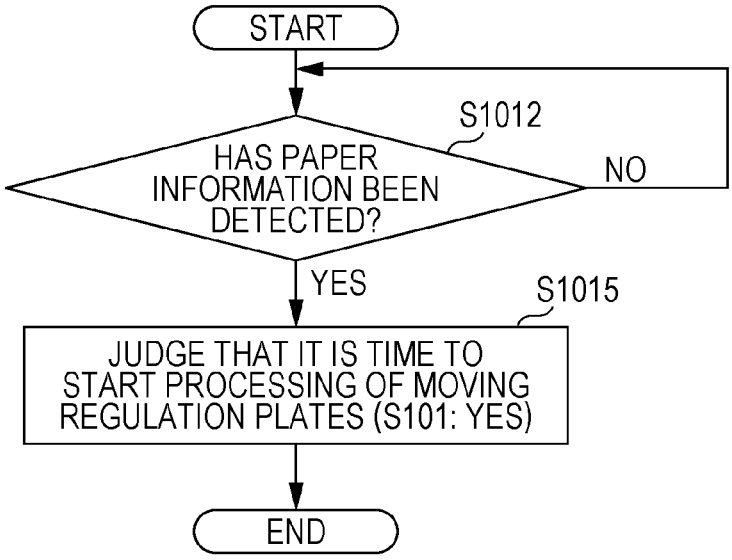

FIGS. 8A and 8B are flowcharts illustrating a procedure for judging a timing of starting processing of movement of the regulation plates 252*b* and 252*d*. As illustrated in FIG. 8A, for example, the controller 21 judges whether or not the paper 90 (paper stack) has been loaded in the paper feed tray 250 (S1011). Here, if the paper 90 is not loaded (S1011: NO), the controller 21 waits for the paper 90 to be loaded. Then, if the paper 90 is loaded (S1011: YES), the controller 21 judges that it is time to start processing of moving the regulation plates 252*b* and 252*d* (S1015). The judgment in step S1011 may be made not only at a time when the paper stack is loaded in the paper feed tray 250, but also at a time when the paper feed tray 250 removed from the paper feed device 20 is loaded again into the paper feed device 20.

As illustrated in FIG. 8B, for example, the controller 21 judges whether or not paper information of the paper stack loaded in the paper feed tray 250 has been detected (S1012). Then, if the paper information has been detected (S1012: YES), the controller 21 judges that it is time to start processing of moving the regulation plates 252*b* and 252*d* (S1015). Note that, in a case of S1012, it is assumed that step of paper information detection (S103) described later is performed first. The paper information detection includes input of paper information from the operation display 34.

According to judgment of the timing of starting processing of movement of the regulation plates 252*b* and 252*d* described above, when it is time to start movement of the regulation plates 252*b* and 252*d* (S101: YES), the controller 21 acquires size information of the loaded paper 90 (S102). Size information is input from the screen of the operation display 34. Note that the size information may be acquired from the medium detection device 50, or may be acquired from a width direction length L1 when the regulation plates 252*b* and 252*d* are moved (described later).

Subsequently, the controller 21 acquires paper information (S103). The paper information is a characteristic of the paper 90 detected by the medium detection device 50, and specifically, for example, a type, basis weight, moisture content, charging rate (amount of static electricity), smoothness of paper edge surfaces, or the like of the paper 90. Note that the paper information may be input from the screen of the operation display 34. In addition, the paper information may be stored in a server (computer) or the like, and may be acquired therefrom via the communicator 29.

Subsequently, the controller 21 acquires environment information (S104). The environment information is acquired by the temperature/humidity sensor 27. In the present embodiment, humidity outside the paper feed device 20 (outside the housing) is detected as environment information on three scales of humidity that are high humidity (H), medium humidity (M), and low humidity (L). However, the environment information may be not only humidity but also temperature or both temperature and humidity. Further, the environment information may be not only humidity outside the paper feed device 20, but also temperature and/or humidity inside the paper feed device 20.

Subsequently, on the basis of the acquired paper size, paper information, and environment information, the controller 21 acquires proper positions of the regulation plates 252*b* and 252*d* from the determination table 221 stored in advance in the storage 22 (S105).

Subsequently, the controller 21 causes the regulation plates 252*b* and 252*d* to move to the acquired proper positions of the regulation plates 252*b* and 252*d* (S106).

(Determination Table)

FIG. 9 is an example of a determination table illustrating a correspondence between characteristics of the paper 90 and proper regulation plate positions. The determination table 221 illustrated in FIG. 9 describes proper positions of the regulation plates 252*b* and 252*d* in the CD direction corresponding to paper characteristics such as paper size, type (paper type) of the paper 90, basis weight, and humidity. Note that FIG. 9 illustrates only standard paper sizes as paper sizes. However, the paper size is not limited to a regular size, and may be an irregular size or the like.

(Step S105)

Figure 10:
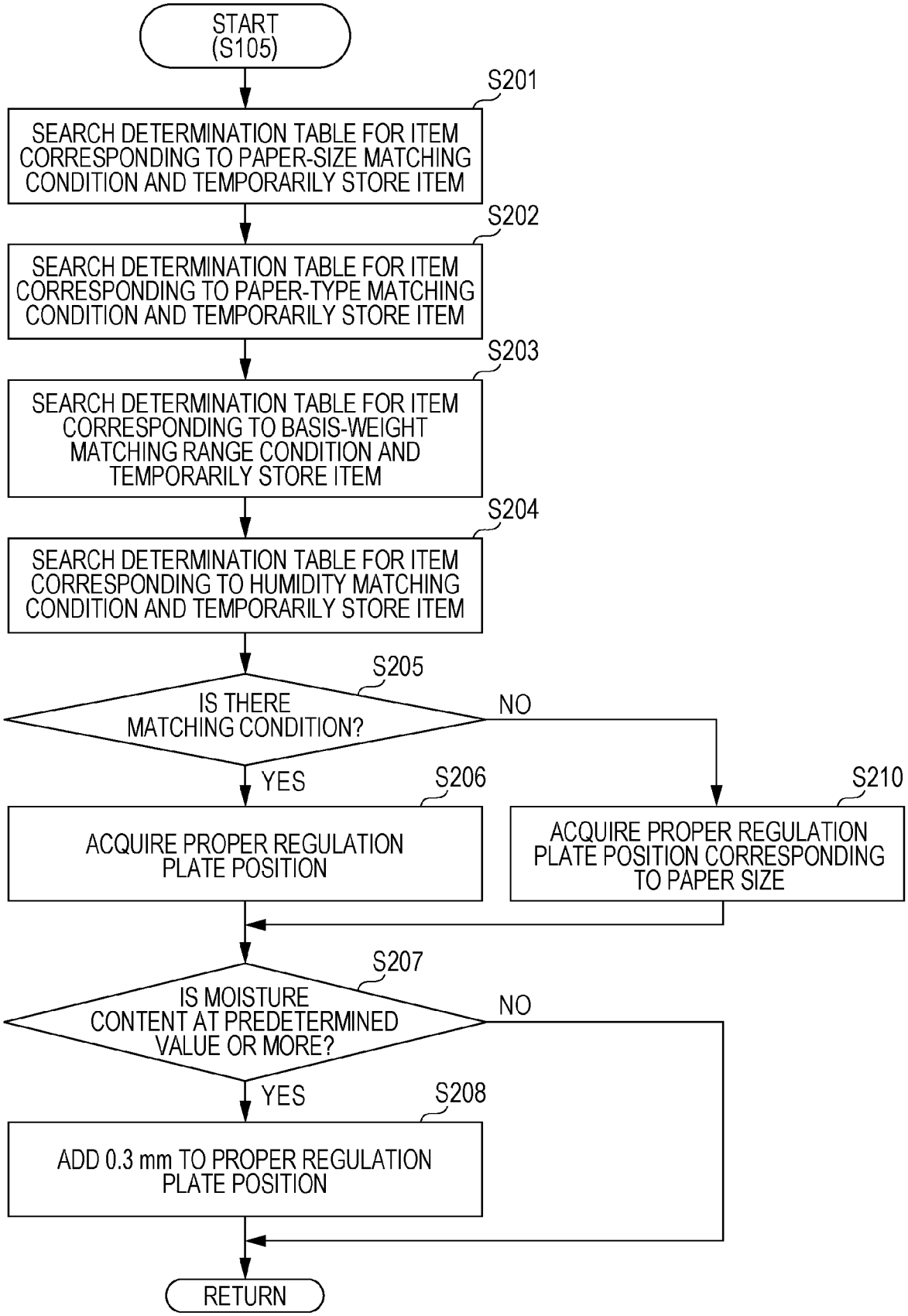
FIG. 10 is a flowchart illustrating a procedure in step S105 in FIG. 7.

Next, a detailed procedure in step S105 will be described. FIG. 10 is a flowchart illustrating a procedure in step S105 in FIG. 7. Described here is a case as an example where the paper 90 of paper size "SRA3 (320×450 mm)", paper type "plain paper (thicker than thick paper 4)", and basis weight "257-g/m$^2$" (257 g/m$^2$ or more) is loaded, and an environmental condition falls within humidity "M".

First, the controller 21 searches the determination table 221 (Refer to FIG. 9. Hereinafter the same.) for an item corresponding to a condition that matches the paper size (S201). If there is a matching paper size in the determination table 221 as a result of the search, the controller 21 temporarily stores the item. In a specific example, the matching paper size "SRA3" is temporarily stored.

Subsequently, the controller 21 searches the determination table 221 for an item corresponding to a condition that matches the paper type (Type of the paper 90. Herein after the same.) (S202). If there is a matching paper type in the determination table 221 as a result of the search, the controller 21 temporarily stores the item. In a specific example, the matching paper type "plain paper (thicker than thick paper 4)" is temporarily stored.

Subsequently, the controller 21 searches the determination table 221 for an item corresponding to a condition that matches the basis weight (S203). If there is a matching basis weight in the determination table 221 as a result of the search, the controller 21 temporarily stores the item. In a specific example, the matching basis weight "257-g/m$^2$" is temporarily stored.

Subsequently, the controller 21 searches the determination table 221 for an item corresponding to a condition that matches the humidity (S204). If there is a matching humidity in the determination table 221 as a result of the search, the controller 21 temporarily stores the item. In a specific example, the matching humidity "M" is temporarily stored.

Subsequently, the controller 21 judges whether or not there is a matching condition in the temporary storage (S205). Here, if there is a matching condition (S205: YES), the controller 21 acquires proper positions of the regulation plates 252*b* and 252*d* for an item corresponding to the matching condition in the determination table 221 (S206). In a specific example, "451.5 mm", which is the proper regulation plate position that matches each of the conditions described above, is acquired from the determination table 221.

Meanwhile, if there is no matching condition (S205: NO), the controller 21 acquires the proper regulation plate position corresponding to the paper size (S210). Note that proper regulation plate positions according to paper sizes are stored not in the determination table 221 but in the storage 22 as standard interval (proper positions) of the regulation plates for the respective paper sizes. (The proper regulation plate positions according to paper sizes may be described in the determination table 221 as standard values.) For example, in a case where a proper regulation plate position cannot be acquired from the determination table 221, if the paper size is SRA3, the paper size in the CD direction is 450.0 mm, which is designated and acquired as the proper position.

Subsequently, the controller 21 judges whether or not the moisture content is at a predetermined value or more (S207). Here, if the moisture content is at the predetermined value or more (S207: YES), the controller 21 adds 0.3 mm to the proper regulation plate position acquired in S206 or S210. Thereafter, the controller 21 brings forward the processing to S106 (return). If the moisture content is not at the predetermined value or more (S207: NO), the controller 21 brings forward the processing as is to S106 (return). Specifically, for example, assuming that the predetermined value of the moisture content is 8%, if the detected moisture content is 8% or more, the controller 21 adds 0.3 mm to the proper regulation plate position. If the detected moisture content is less than 8%, the controller 21 sets the proper regulation plate position as is.

Note that the value to be added according to the moisture content may not be 0.3 mm, and moisture content and a corresponding addition value may be described in detail in the determination table 221 (or in a dedicated table). For example, every time the moisture content increases by 3%, the proper regulation plate position is increased by 0.1 mm, or the like.

In step S208, the proper regulation plate position is changed according to moisture content of the paper 90. However, the embodiment is not limited thereto. In addition to moisture content of the paper 90, characteristics that can be detected from the paper 90 by the medium detection device 50 can be utilized for changing the proper position. Specifically, examples of the characteristics include charging amount of the paper 90, Bekk smoothness of the paper edge surfaces of the paper, and the like. Specifically, for example, in a case where a surface of the paper has an electric resistance of $10^{13}\Omega$ or more, the proper regulation plate position is increased by 0.3 mm. For example, in a case where the Bekk smoothness is 200 seconds or less, the proper regulation plate position is increased by 0.3 mm. Of course, these values can be arbitrarily set.

In the present embodiment, the proper regulation plate position in the CD direction is defined in advance in the determination table 221. This is because the positions of the regulation plates 252*b* and 252*d* in the CD direction are more likely to cause a defect during image formation than the position of the regulation plate 252*c* in the FD direction is. However, not limited to the CD direction, proper positions of the regulation plates in the FD direction may also be defined in advance in the determination table 221.

As described above, according to the first embodiment, proper positions of the regulation plates 252*b* and 252*d* are obtained from the determination table 221 on the basis of characteristics of the paper 90 detected by using the medium detection device 50, and the regulation plates 252*b* and 252*d* are moved to the proper positions. Accordingly, according to the present embodiment, it is possible to reduce chances of occurrence of a paper jam caused by inappropriate positions of the regulation plates 252*b* and 252*d*.

Second Embodiment

A second embodiment is an example of acquiring proper positions of regulation plates 252*b* and 252*d* from a paper profile. A device configuration of an image formation system 1000 and the like is similar to the device configuration in the first embodiment. A procedure for moving regulation plates 252*b* and 252*d* is similar to the procedure for moving the regulation plates 252*b* and 252*d* in the first embodiment except for processing of acquiring proper positions of the regulation plates 252*b* and 252*d* from a paper profile.

FIG. 11 is a diagram illustrating an example of a determination table 221 illustrating a correspondence between paper profiles and proper regulation plate positions. In the determination table 221 illustrated in FIG. 11, a paper name (product name) is used as a paper profile, and a proper regulation plate position in a CD direction is determined corresponding to the paper name.

Figure 12:
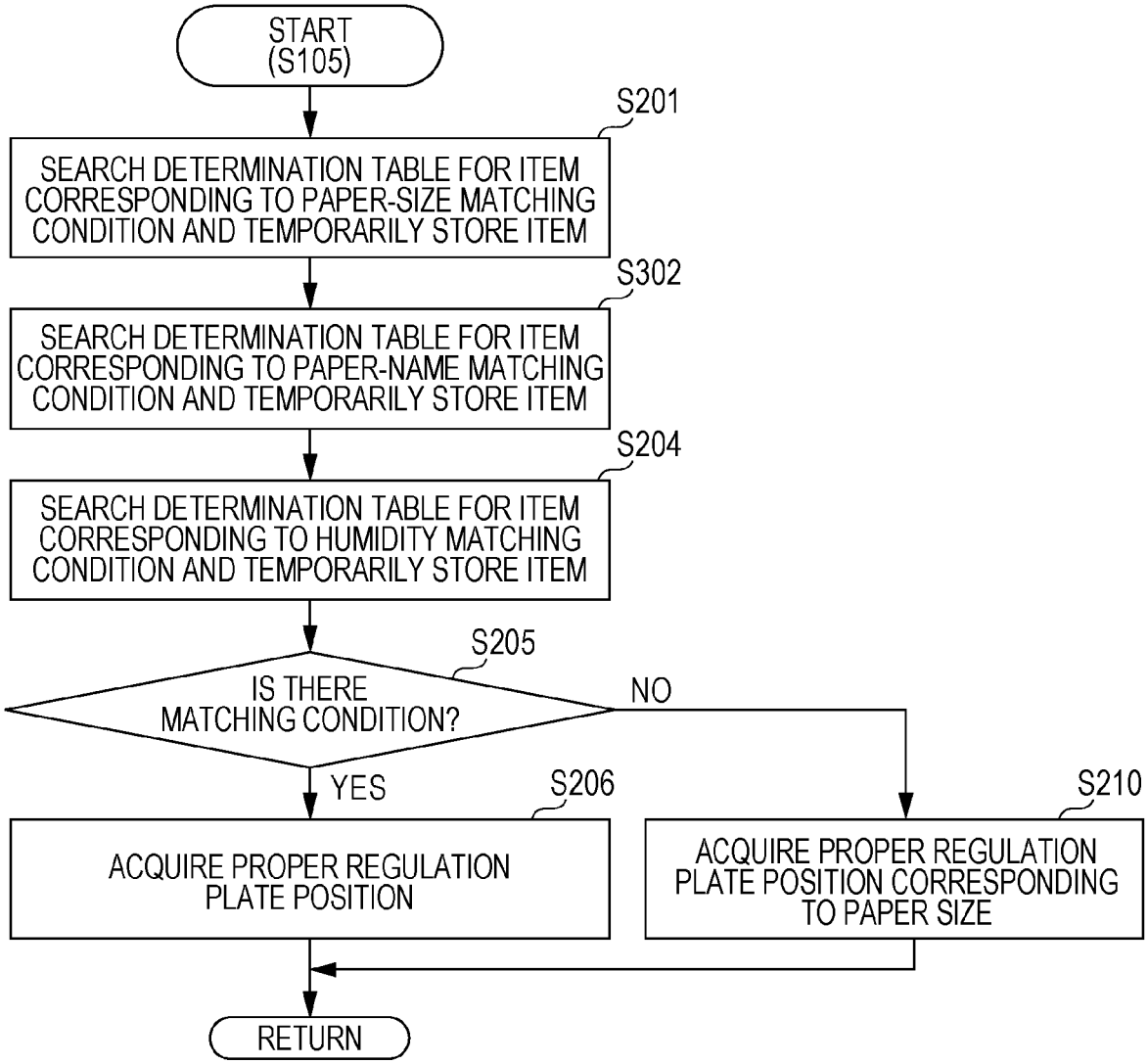
FIG. 12 is a flowchart illustrating a procedure in step S105 in an example of acquiring proper positions of the regulation plates from a paper profile.

FIG. 12 is a flowchart illustrating a procedure in step S105 in an example of acquiring proper positions of the regulation plates from a paper profile. Note that, in the following description, the same processing as processing in the flowchart illustrated in FIG. 10 is denoted by the same step number (S number), and description of a part of the processing is omitted. Described here is a specific example of a case where paper 90 having a paper name "ABC company Kent paper 123" is loaded, and an environmental condition is humidity "M".

First, a controller 21 searches the determination table 221 (Refer to FIG. 11. Hereinafter the same.) for an item corresponding to a condition that matches the paper size (S201). A search result is temporarily stored.

Subsequently, the controller 21 searches the determination table 221 for an item corresponding to a condition that matches the paper name (paper profile) (S302). If there is a matching paper name in the determination table 221 as a result of the search, the controller 21 temporarily stores the item. In the specific example, the matching paper name "ABC company Kent paper 123" is temporarily stored.

Figure 13:
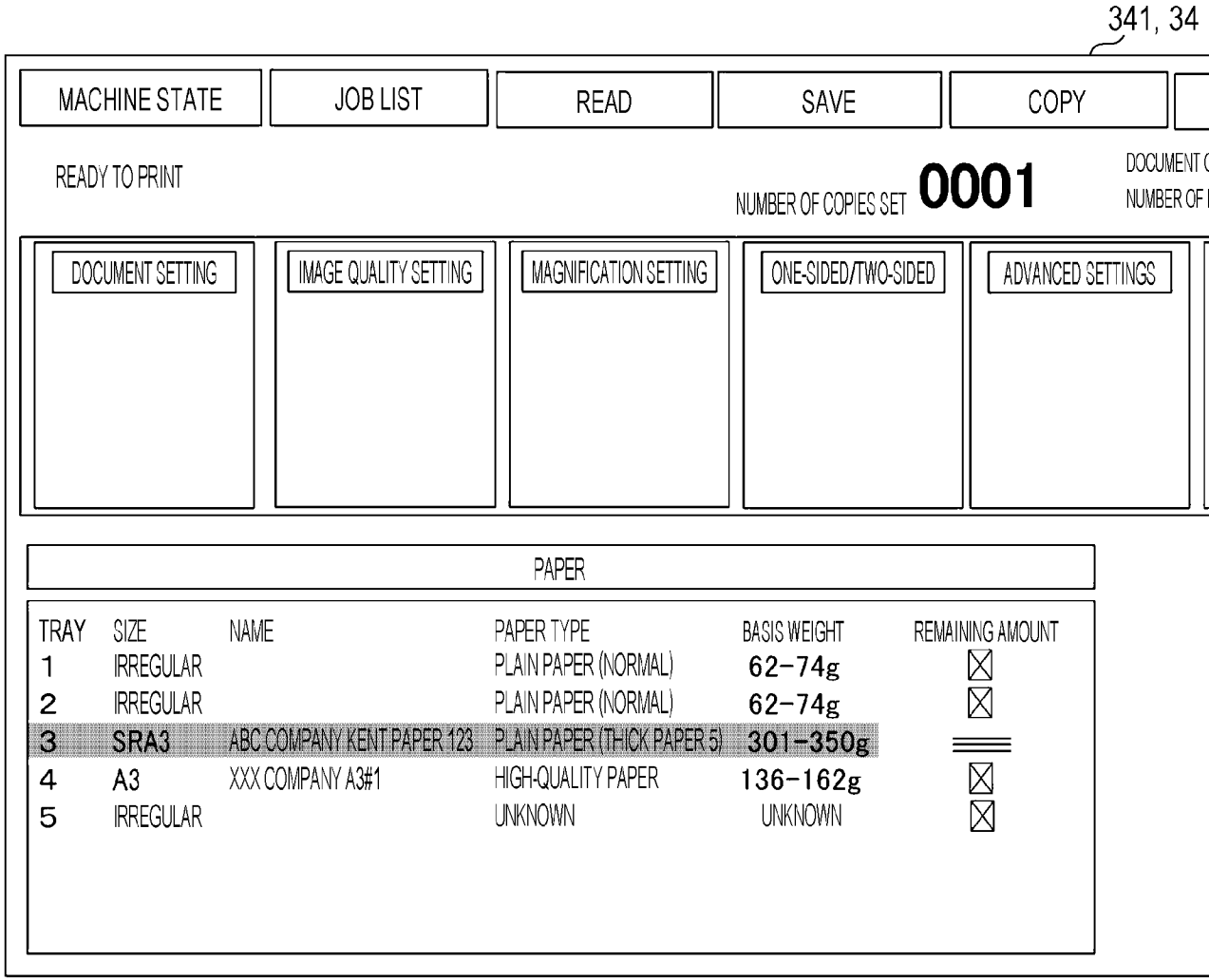
FIG. 13 is a screen example of an operation display on which an input screen is displayed.

Here, the paper name as the paper profile is input from an operation display 34. Therefore, the operation display 34 serves as a paper profile inputter. FIG. 13 is a screen example of the operation display 34 on which an input screen is displayed.

As illustrated in FIG. 13, a screen for inputting a paper name is displayed on an operation screen 341 of the operation display 34. The operation screen 341 displays paper names of a plurality of paper profiles stored in advance, and a user can select a paper name from among the paper profiles. In this screen example, the paper name "ABC company Kent paper 123" is selected. In addition to the paper name, a stored paper profile is, for example, at least one of paper type, paper size, basis weight, image formation condition for paper, and the like of the paper 90. The image formation condition for paper is, for example, charging potential of a photoreceptor, a development condition, an exposure condition, a transfer condition, or the like defined for each paper type. Although not illustrated, smoothness of edge surfaces of the paper 90 may be described in the paper profile. Furthermore, the paper type, paper size, basis weight, image formation condition for paper, and the like of the paper 90 may be not only input as a paper profile but also input from the operation display 34 separately from the paper profile. In this case, the operation display 34 serves as an inputter (paper type inputter) that receives input thereof.

Subsequently, the controller 21 searches the determination table 221 for an item corresponding to a condition that matches the humidity (S204). A search result is temporarily stored. In a specific example, the matching humidity "M" is temporarily stored.

Subsequently, the controller 21 judges whether or not there is a matching condition in the temporary storage (S205). Here, if there is a matching condition (S205: YES), the controller 21 acquires a proper regulation plate position for an item corresponding to the matching condition in the determination table 221 (S206). In a specific example, "451.5 mm", which is the proper regulation plate position that matches each of the conditions described above, is acquired from the determination table 221.

Meanwhile, if there is no matching condition (S205: NO), the controller 21 acquires the proper regulation plate position corresponding to the paper size (S210). Note that proper regulation plate positions according to paper sizes are stored not in the determination table 221 but in the storage 22 as standard interval (proper positions) of the regulation plates for the respective paper sizes. (The proper regulation plate positions according to paper sizes may be described in the determination table 221 as standard values.) For example, in a case where a proper regulation plate position cannot be acquired from the determination table 221, if the paper size is SRA3, the paper size in the CD direction is 450.0 mm, which is acquired as the proper position.

Thereafter, the controller 21 brings forward the processing to S106 (return).

Thus, by acquiring a proper regulation plate position from paper profiles stored in advance, it is possible to obtain a proper regulation plate position corresponding to a paper profile without using the medium detection device 50.

In the second embodiment, the regulation plates 252*b* and 252*d* are moved according to a paper profile stored in advance. Further, the medium detection device 50 may detect a characteristic of the paper 90. In a case where a characteristic of the paper 90 is detected by the medium detection device 50, the stored paper profile may be updated according to the detected paper characteristic, or the proper regulation plate position may be acquired by utilizing the detected paper characteristic as in the first embodiment to move the regulation plates.

In the second embodiment also, a proper regulation plate position in an FD direction may be defined in advance in the determination table 221.

Third Embodiment

A third embodiment is another example in which regulation-plate movement processing start timing is obtained in step S101 already described. According to the third embodiment, regulation-plate movement processing start timing is judged by pressure applied to regulation plates. A device configuration of an image formation system 1000 and the like is similar to the device configuration in the first embodiment. A procedure for moving regulation plates is similar to the procedure for moving the regulation plates in the first or second embodiment except for processing for regulation-plate movement processing start timing.

Figure 14:
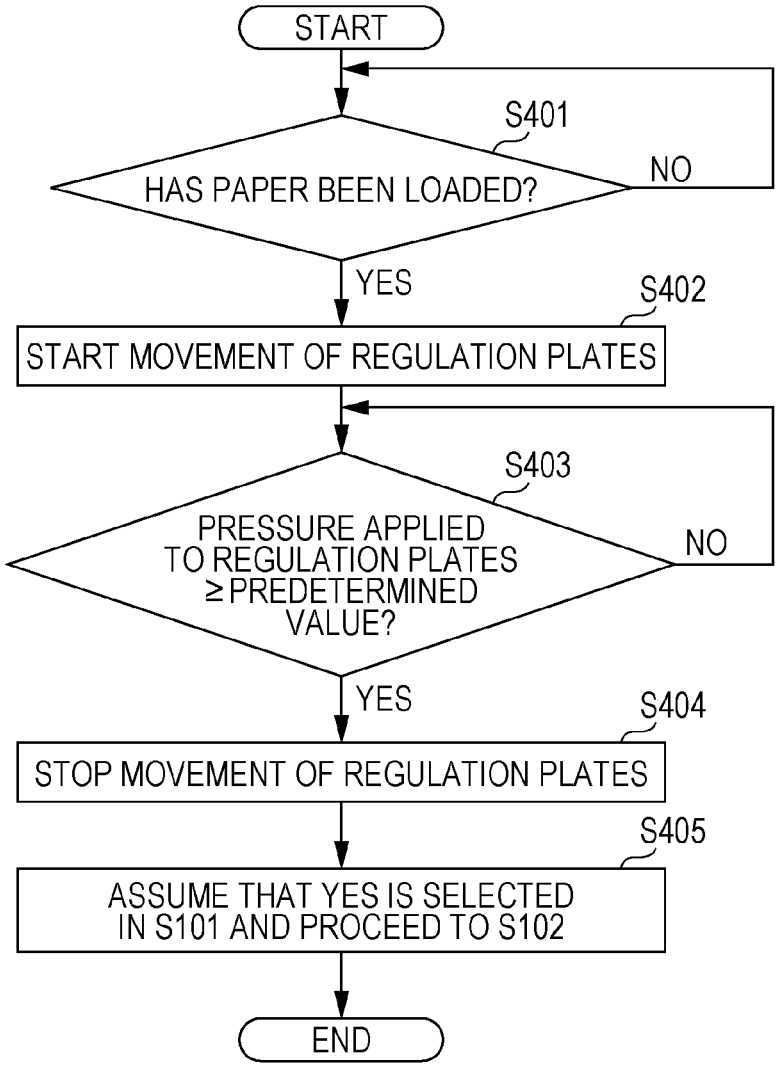
FIG. 14 is a flowchart illustrating a procedure of another example of the regulation-plate movement processing start timing.

FIG. 14 is a flowchart illustrating a procedure of another example of the regulation-plate movement processing start timing.

First, a controller 21 judges whether or not paper 90 (paper stack) has been loaded in a paper feed tray 250 (S401). Here, if the paper 90 is not loaded (S401: NO), the controller 21 waits for the paper 90 to be loaded.

At this time, regulation plates 252*b* and 252*d* are opened so as to have a width that allows maximum-size paper 90 to be loaded.

Then, if the paper 90 is loaded (S401: YES), the controller 21 starts movement of the regulation plates (S402).

Subsequently, the controller 21 judges whether or not pressure applied to the regulation plates 252*b* and 252*d* is at a predetermined value or more (S403). Here, if the pressure applied to the regulation plates 252*b* and 252*d* is less than the predetermined value (S403: NO), the controller 21 waits until the pressure exceeds the predetermined value. The pressure applied to the regulation plates 252*b* and 252*d* is obtained, for example, by measuring torque of a motor of a driver 254. In addition, a pressure gauge may be attached to each of the regulation plates 252*b* and 252*d* on a side in contact with a paper edge surface to measure pressure applied to the regulation plates 252*b* and 252*d*. Pressure values obtained by these measurement methods vary depending on the measurement method. Therefore, a predetermined value may be determined by measuring pressure of when the regulation plates 252*b* and 252*d* are brought into contact with paper edge surfaces according to the measurement method.

If the pressure applied to the regulation plates exceeds the predetermined value (S403: YES), the controller 21 stops the movement of the regulation plates (S404). Accordingly, the regulation plates 252*b* and 252*d* stop while being in contact with the edge surfaces in the width direction of the paper 90.

Thereafter, the controller 21 assumes that YES is selected in step S101 in the flowchart illustrated in FIG. 7, and proceeds to processing in S102 (S405). Thereafter, as described above, the controller 21 moves the regulation plates to proper positions by executing the processing in and after S201.

Thus, according to the third embodiment, the regulation plates 252*b* and 252*d* are first brought into contact with the edge surfaces of the paper 90 with a certain degree of force, and then moved to proper positions. Therefore, according to the third embodiment, it is possible to move the regulation plates 252*b* and 252*d* to proper positions even when the paper 90 of an unknown size is loaded or when a paper size is not input.

Fourth Embodiment

According to a fourth embodiment, a regulation plate position, paper information, and jam occurrence information are saved in association with one another. A device configuration of an image formation system 1000 is similar to the device configuration in the first embodiment. A procedure for moving the regulation plates is similar to the procedure for moving the regulation plates in any one of the first to third embodiments.

Figure 15:
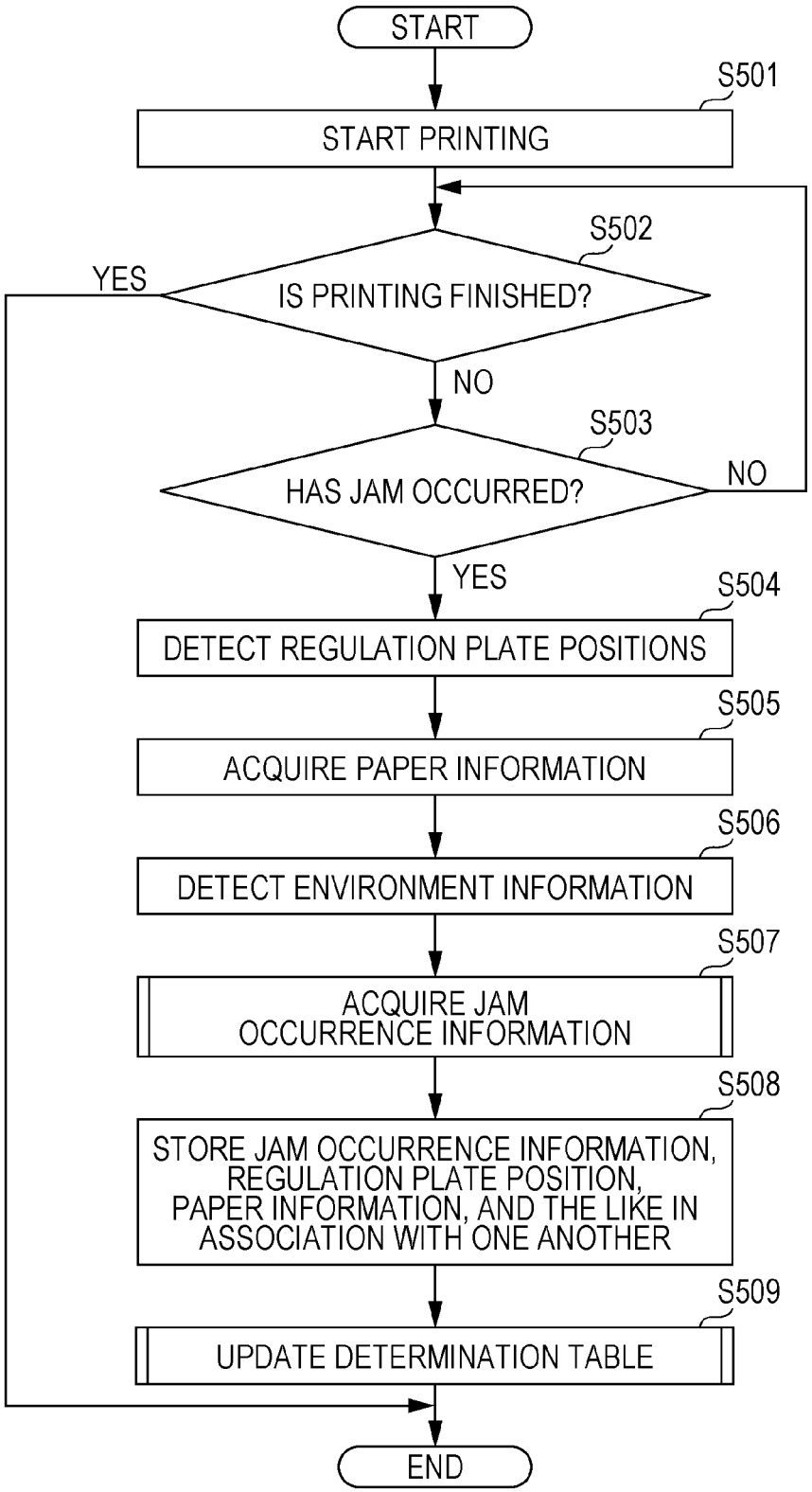
FIG. 15 is a flowchart illustrating a procedure for saving a regulation plate position, paper information, and jam occurrence information in association with one another.

FIG. 15 is a flowchart illustrating a procedure for saving a regulation plate position, paper information, and jam occurrence information in association with one another. This procedure is performed by a controller 21 and an image formation controller 31 in cooperation with each other. Note that, in a case where the image formation controller 31 also functions as the controller 21 of the paper feed device 20, processing is performed by the image formation controller alone. In addition, this processing procedure is processing performed after paper 90 (paper stack) is set in a paper feed device 20 and the regulation plates are moved to proper positions.

First, print start input from an operation display 34 causes the image formation controller 31 to start image formation (S501).

Subsequently, the image formation controller 31 judges whether or not printing is finished (S502). The finish of printing is judged on the basis of, for example, whether or not a last sheet in a job has been ejected and printing operation by an image formation device 30 has stopped. Here, if the printing is finished (S502: YES), the image formation controller 31 ends the processing.

Meanwhile, if the printing is not finished (S502: NO), the image formation controller 31 subsequently judges whether or not a jam has occurred during printing (S503). The jam occurrence is determined on the basis of whether or not the paper 90 has reached each of sensors S2 and S11 to S13. In the present embodiment, a stop instruction by a user is also regarded as a jam occurrence. If a jam has not occurred (S503: NO), the processing returns to S502, and the image formation controller 31 continues the printing operation.

Meanwhile, if occurrence of a jam is detected during printing (S503: YES), the image formation controller 31 transmits the occurrence of the jam to the controller 21, and the controller 21 detects a position of the regulation plate 252 at that time from a regulation plate position detector 23 (S504).

Subsequently, the controller 21 acquires paper information (S505). The paper information acquired here is paper information detected by a medium detection device 50 (first embodiment), paper information stored as a paper profile (second embodiment), or the like, and is read from a storage 22 and acquired. In particular, here, a paper type and basis weight are acquired.

Subsequently, the controller 21 acquires environment information (S506). The environment information acquired here is humidity at this time.

Subsequently, the controller 21 acquires jam information (S507). A procedure for acquiring jam information will be described later.

Subsequently, the controller 21 updates jam history 222 (S508). FIG. 16 is a diagram illustrating an example of the jam history 222.

As illustrated in FIG. 16, the jam history 222 is table data in which a paper size, paper type, and basis weight of the paper 90, humidity, regulation plate position, the number of occurrences of A jam, and the number of occurrences of B jam are associated with one another. When a jam occurs, the controller 21 increments and updates a numerical value of the number of occurrences of A jam or the number of occurrences of B jam as the jam history 222.

The A jam is a jam in which conveyance of the paper 90 is stopped during feeding of the paper 90. For example, in a case where the paper 90 does not reach the sensors S2 and S11 to S13 in the paper feed device 20 and in the image formation device 30, it is determined that an A jam has occurred. Specifically, for example, this is a case where the paper 90 does not reach a sensor (S2 in FIG. 3A), which detects the paper 90 first after the paper 90 is started to be fed and conveyed from the paper feed tray 250. Thus, a jam in which paper feed itself is not performed is referred to as an unfed paper jam. Such an A jam corresponds to first jam information caused by regulation plate positions being narrower than an appropriate range.

The B jam is a jam in which a defect occurs in image formation due to the paper 90 being conveyed at an angle, or the like, and printing is stopped. Such a B jam corresponds to second jam information caused by regulation plate positions being wider than an appropriate range.

As an example, in JAM 1 illustrated in FIG. 16, paper size=SRA3, paper type=plain paper (thicker than thick paper 4), basis weight=257 g/m$^2$ or more, humidity=H, regulation plate position=451.2, and the current number of occurrences of A jam is 2. When an A jam further occurs in the paper 90, the controller 21 increments the number of occurrences of A jam to 3 and updates storage of the jam history 222. Similarly, in JAM 2, paper size=SRA3, paper type=plain paper (thicker than thick paper 4), basis weight=257 g/m$^2$ or more, humidity=M, regulation plate position=451.5, and the current number of occurrences of B jam is 2. When a B jam further occurs in the paper 90, the controller 21 increments the number of occurrences of B jam to 3 and updates storage of the jam history 222.

Subsequently, the controller 21 updates a determination table 221 for determining a proper regulation plate position on the basis of the updated jam history 222 (S509).

Thereafter, when the paper 90 is loaded in the paper feed device 20, regulation plates 252*b* and 252*d* are moved to proper positions according to any one of the first to third embodiments in accordance with the updated determination table 221.

Figure 17:
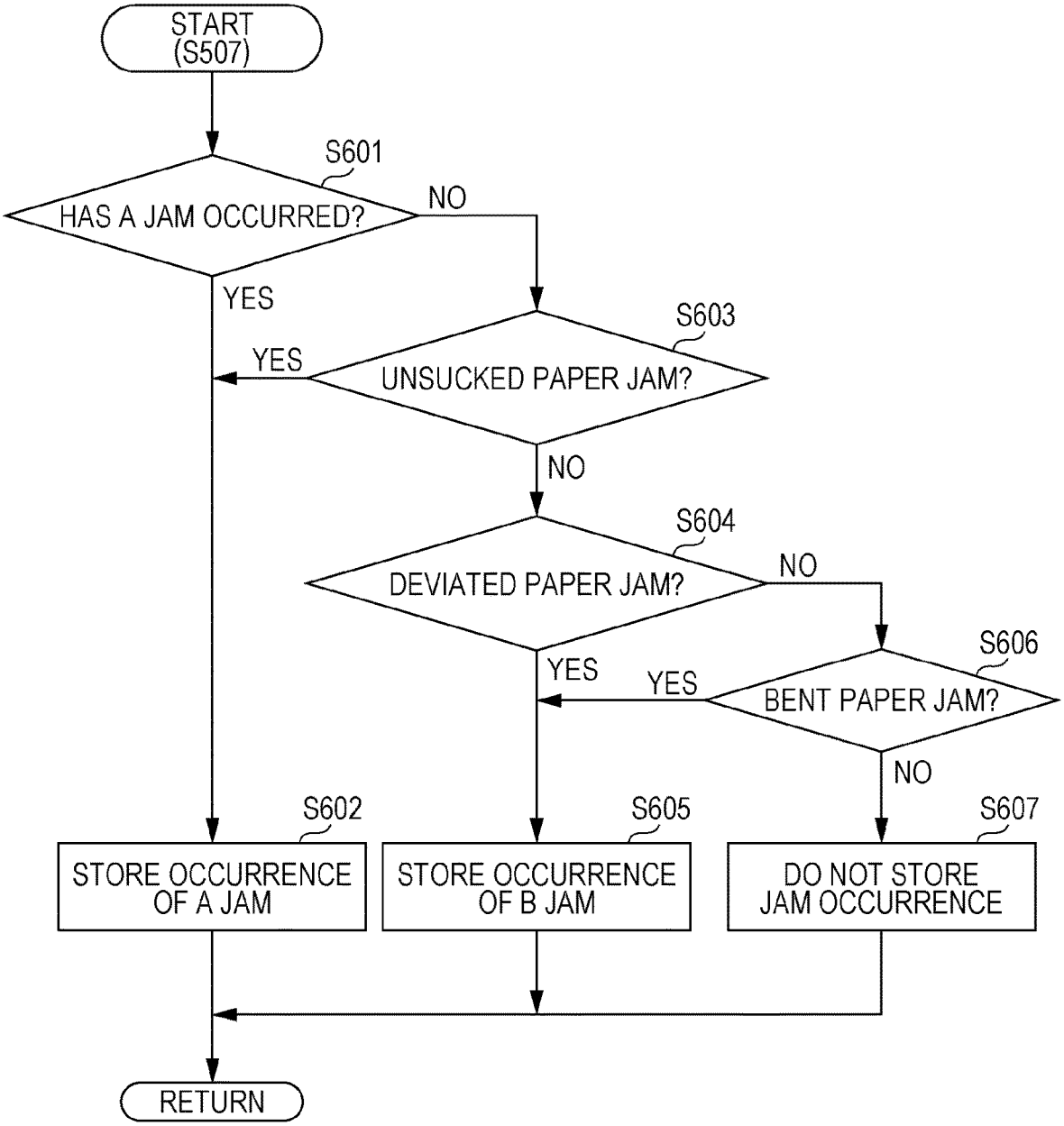
FIG. 17 is a flowchart illustrating a procedure for acquiring jam information in step S507 in FIG. 15.

FIG. 17 is a flowchart illustrating a procedure for acquiring jam information in step S507.

First, the controller 21 judges whether or not the jam that has occurred in S503 is an A jam (unfed paper jam) (S601). In a case where the jam that has occurred is an A jam (S601: YES), the controller 21 stores the occurrence of the A jam to the paper 90 as the jam history 222 (S602).

Meanwhile, in a case where the jam that has occurred is not an A jam (S601: NO), the controller 21 judges whether or not the jam is an unsucked paper jam (S603). After paper feed is started, a sensor S4 (refer to FIG. 4) determines whether or not the paper 90 in a paper feed tray 250*c* is sucked up by a suction fan, raised, and sucked onto a paper feed belt. When there is no ON signal (paper suction OK) from the sensor S4, the controller 21 judges that an unsucked paper jam has occurred (S603: YES). An unsucked paper jam is also one of the A jams in which paper is not fed and conveyed. Therefore, the controller 21 stores the occurrence of the A jam to the paper 90 as the jam history 222 (S602).

If the jam is not an unsucked paper jam (S603: NO), the controller 21 determines whether or not the jam that has occurred is a deviated paper jam (S604). A deviated paper jam is not a jam due to a paper jam, and is detected by a deviation detection sensor installed at a predetermined position on a paper conveyance path. As described in the first embodiment, for example, a line image sensor is configured as a sensor S11 and is used as a deviation sensor. If deviation of a predetermined amount or more occurs with the paper 90 under conveyance on which an image is formed, the image cannot be correctly formed (deviation of the image cannot be completely corrected). Therefore, the user determines that a defective image is generated and stops the printing operation. In a case of a deviated paper jam (in a case of detection by the deviation sensor and an image formation stop instruction) (S604: YES), the controller 21 stores the occurrence of the B jam to the paper 90 as the jam history 222 (S605).

If the jam is not a deviated paper jam (S604: NO), the controller 21 determines whether or not the jam that has occurred is a bent paper jam (S606). Similarly to a deviated paper jam, a bent paper jam also causes image formation defect. Bent paper can also be detected by detecting a paper width and length by using the sensor S11 as a line image sensor. For example, the controller 21 detects a paper width and a paper length from an image obtained by the sensor S11, and, if the paper 90 is smaller than a regulation size, determines (or the image formation controller 31 may determine) this state to be a bent paper jam. In a case where the jam that has occurred is a bent paper jam (S606: YES), the controller 21 stores the occurrence of a B jam to the paper 90 as the jam history 222 (S605).

If the jam is not a bent paper jam (S606: NO), the controller 21 does not store the occurrence of the jam (S607). This is processing for not leaving jams unclassified in S601 to S606 in the jam history 222.

Figure 18:
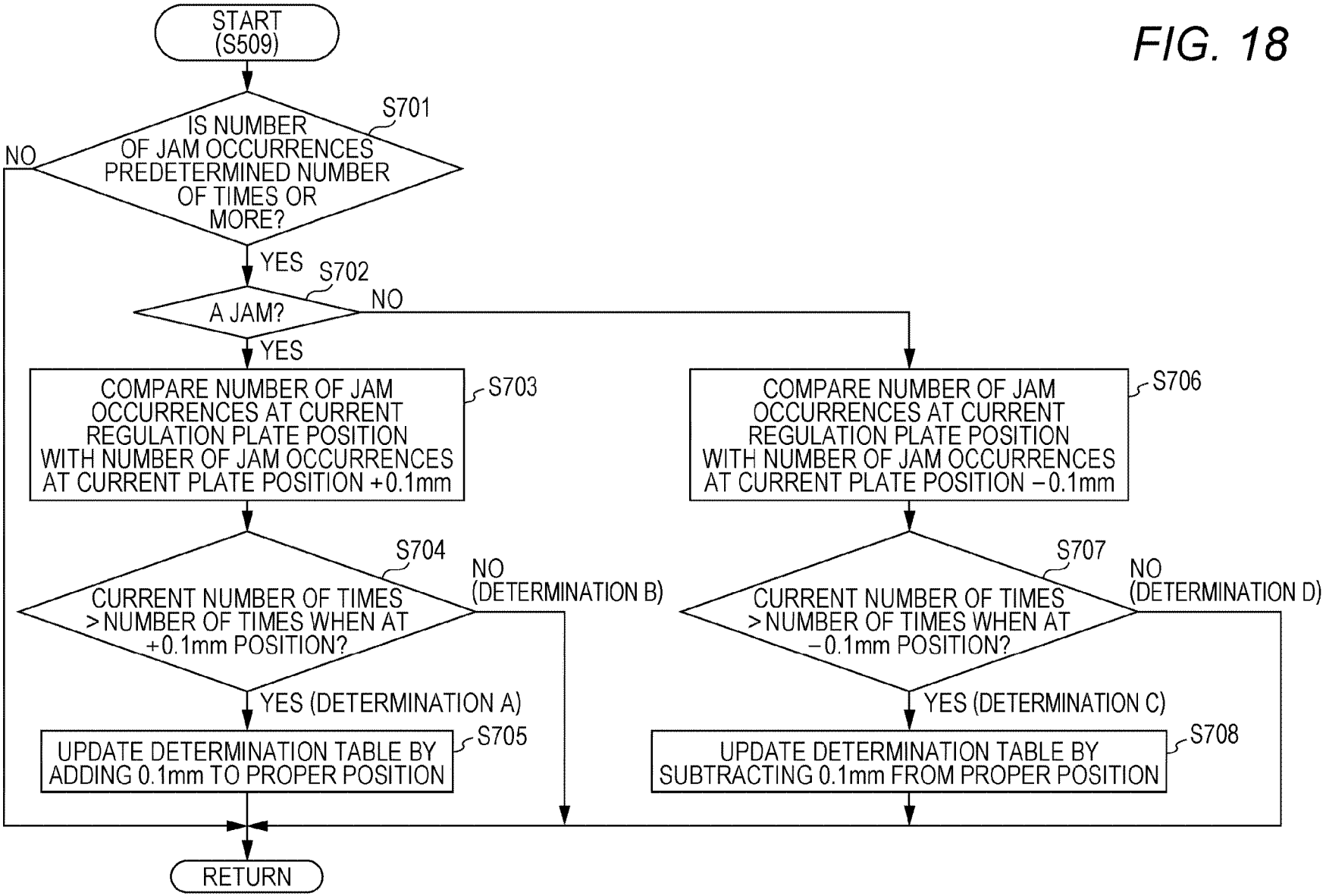
FIG. 18 is a flowchart illustrating a procedure for updating a determination table in step S509 in FIG. 15.

FIG. 18 is a flowchart illustrating a procedure for updating the determination table 221 in step S509.

First, the controller 21 judges whether or not the number of jams stored in step S508 is a predetermined number of times or more (S701). Here, if the number of jams is less than the predetermined number of times (S701: NO), the controller 21 returns to an original state (refer to FIG. 15), and the processing ends. In this case, the determination table 221 is not updated.

Here, for example, it is assumed that the controller 21 updates the number of jams, which has been 2 in S508, to 3 and stores the number of jams as 3. Then, if the predetermined number of times is 3, the controller 21 judges that the number of times is equal to or more than the predetermined number of times (S701: YES).

Subsequently, the controller 21 determines whether or not the occurred jam is an A jam (S702). In the present embodiment, if the jam is not an A jam, the jam is a B jam.

In a case where it is judged in step S702 that the jam is an A jam (S702: YES), subsequently, the controller 21 compares the number of occurrences of A jam at a current regulation plate position with the number of occurrences of A jam at the current plate position+0.1 mm (S703).

In a case where the number of jam occurrences at the current regulation plate position is larger than when at the +0.1 mm position (S704: YES (referred to as determination A)) as a result of the comparison, the controller 21 adds 0.1 mm to the proper regulation plate position shown in the table to update the determination table 221 (S705).

Meanwhile, in a case where the number of jam occurrences at the current regulation plate position is less than when at the +0.1 mm position (S704: NO (referred to as determination B)), the controller 21 returns to an original state, and the processing ends. In this case, the determination table 221 is not updated.

In a case where it is judged in step S702 that the jam is not an A jam (S702: NO), that is, in a case where it is judged that the jam is a B jam, subsequently, the controller 21 compares the number of occurrences of B jam at a current regulation plate position with the number of occurrences of B jam at the current plate position −0.1 mm (S706).

In a case where the number of jam occurrences at the current regulation plate position is larger than when at the −0.1 mm position (S707: YES (referred to as determination C)) as a result of the comparison, the controller 21 subtracts 0.1 mm from the proper regulation plate position shown in the table to update the determination table 221 (S708). Thereafter, the controller 21 ends the processing.

Meanwhile, in a case where the number of jam occurrences at the current regulation plate position is less than when at the −0.1 mm position (S707: NO (referred to as determination D)), the controller 21 returns to an original state, and the processing ends. In this case, the determination table 221 is not updated.

An example of updating the determination table will be described. FIG. 19 is an explanatory diagram for describing an example of updating the determination table 221.

For example, as in JAM 1 illustrated in FIG. 16, in a case where the current regulation plate position is 451.2 mm, and the number of occurrences of A jam in that case is updated from 2 to 3 and stored, the controller 21 compares the number of occurrences of A jam with the number of occurrences of A jam 0 in a case of +0.1 mm (regulation plate position 451.3 mm). As a result of the comparison, the number of occurrences of A jam at the current regulation plate position of 451.2 mm is larger. In such a case, as the determination A (S703: YES), as illustrated in FIG. 19, the controller 21 adds 0.1 mm to 451.2 mm of the proper regulation plate position shown in the table, and updates the determination table 221 such that the proper regulation plate position is set to 451.3 mm (S705).

Further, as in JAM 2 illustrated in FIG. 16, in a case where the current regulation plate position is 451.5 mm, and the number of occurrences of B jam in that case is updated from 2 to 3 and stored, the controller 21 compares the number of occurrences of B jam with the number of occurrences of B jam 4 in a case of −0.1 mm (regulation plate position 451.4 mm). As a result of the comparison, the number of occurrences of B jam in the case of −0.1 mm (regulation plate position 451.4 mm) is larger. In such a case, as the determination D (S706: NO), the controller 21 ends the processing as is.

Accordingly, in the present embodiment, in a case where the number of occurrences of jam increases at a current proper regulation plate position, the proper regulation plate position is updated in increments of 0.1 mm.

Note that, in an update of the determination table 221, instead of the above-described processing, for example, the number of occurrences of jam may be recorded in advance for each of a plurality of regulation plate positions, and a regulation plate position having a smallest number of occurrences of jam and having a narrowest regulation plate position may be adopted as an optimum regulation plate position for each jam occurrence. Specifically, for example, as illustrated in FIG. 16, the number of occurrences of jam at five regulation plate positions recorded for each humidity level of each paper 90 is recorded. Then, when a jam occurs, the controller 21 compares them, and stores a regulation plate position that meets a condition of having a smallest number of occurrences of jam and having a narrowest regulation plate position as an optimum value for the paper 90 at a time of the humidity level. Thereafter, the controller 21 uses the optimum value for the same paper 90 and humidity level.

Fifth Embodiment

Next, error processing will be described. A fifth embodiment is a processing example in a case where movement of regulation plates is not completed within a predetermined time. A device configuration of an image formation system 1000 and a procedure for moving the regulation plates is similar to the device configuration of the image formation system 1000 and procedure for moving the regulation plates in any one of the first to fourth embodiments.

Figure 20:
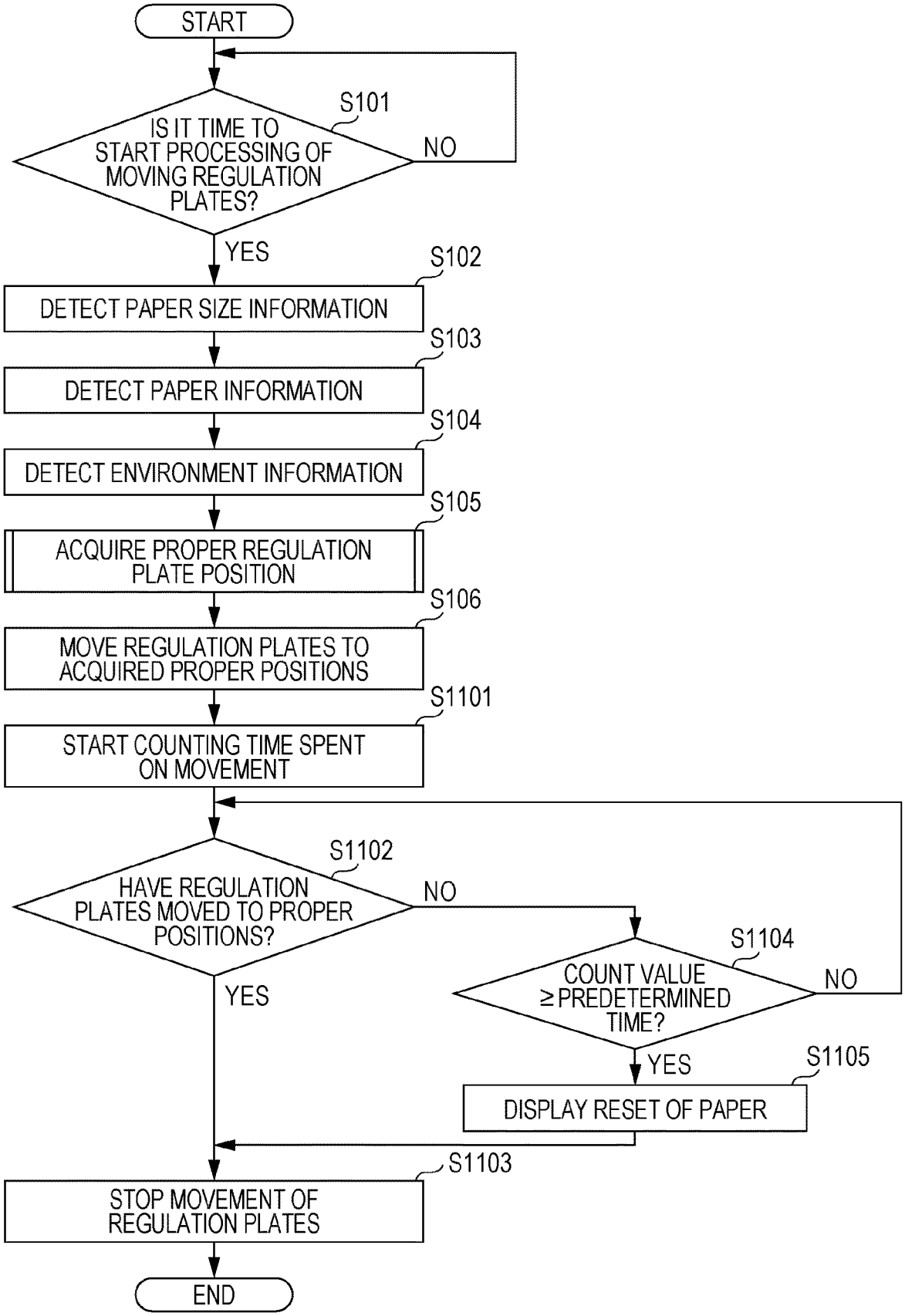
FIG. 20 is a flowchart illustrating a procedure for controlling movement of regulation plates in a fifth embodiment.

FIG. 20 is a flowchart illustrating a procedure for controlling movement of the regulation plates in the fifth embodiment.

First, a controller 21 executes steps S101 to S106 (refer to FIG. 7) in the first embodiment. After starting movement of regulation plates 252*b* and 252*d* (S106), the controller 21 starts counting time spent on the movement (S1101).

Subsequently, the controller 21 judges whether or not the regulation plates 252*b* and 252*d* have moved to the proper positions (S1102). Here, if the movement is completed (S1102: YES), the controller 21 stops the movement of the regulation plates 252*b* and 252*d* (S1103). Thereafter, the controller 21 ends all of the processing.

In step S1102, if the movement of the regulation plates 252*b* and 252*d* to the proper positions is not completed (S1102: NO), the controller 21 judges whether or not a count value (time) is equal to or longer than a predetermined time (S1104). The predetermined time is, for example, time spent on movement of the regulation plates 252*b* and 252*d* from a maximum to minimum width therebetween. Specifically, in a case where a maximum loadable paper size is A3 Nobi (also referred to as A3+) (=329×483 mm) and a minimum loadable paper size is A6 (=105×148 mm), the predetermined time is about 15 seconds. Here, if the count value (time) is not equal to or longer than the predetermined time (S1104: NO), the processing returns to step S1102 and the controller 21 continues the processing.

Meanwhile, if the count value (time) is equal to or longer than the predetermined time (S1104: YES), the controller 21 causes a display 24 or an operation display 34 to display reset of paper 90 (S1105). The display of reset of the paper 90 is processing of notifying the user that some error has occurred during movement of the regulation plates 252*b* and 252*d*. As a cause of not completing the movement of the regulation plates 252*b* and 252*d* within the predetermined time, for example, it can be considered that the paper is greatly bent at a time of paper setting, and such a failure in setting the paper 90 is highly likely to be resolved by resetting the paper 90. In addition, as another cause of not completing the movement of the regulation plates 252*b* and 252*d* within the predetermined time, for example, abnormality of the device itself such as a motor or a sensor can be considered. In a case of such device abnormality, the device abnormality may be separately detected and an error may be displayed, or the like.

Thereafter, the controller 21 stops the movement of the regulation plates 252*b* and 252*d* (S1103), and ends all the processing.

Figure 21:
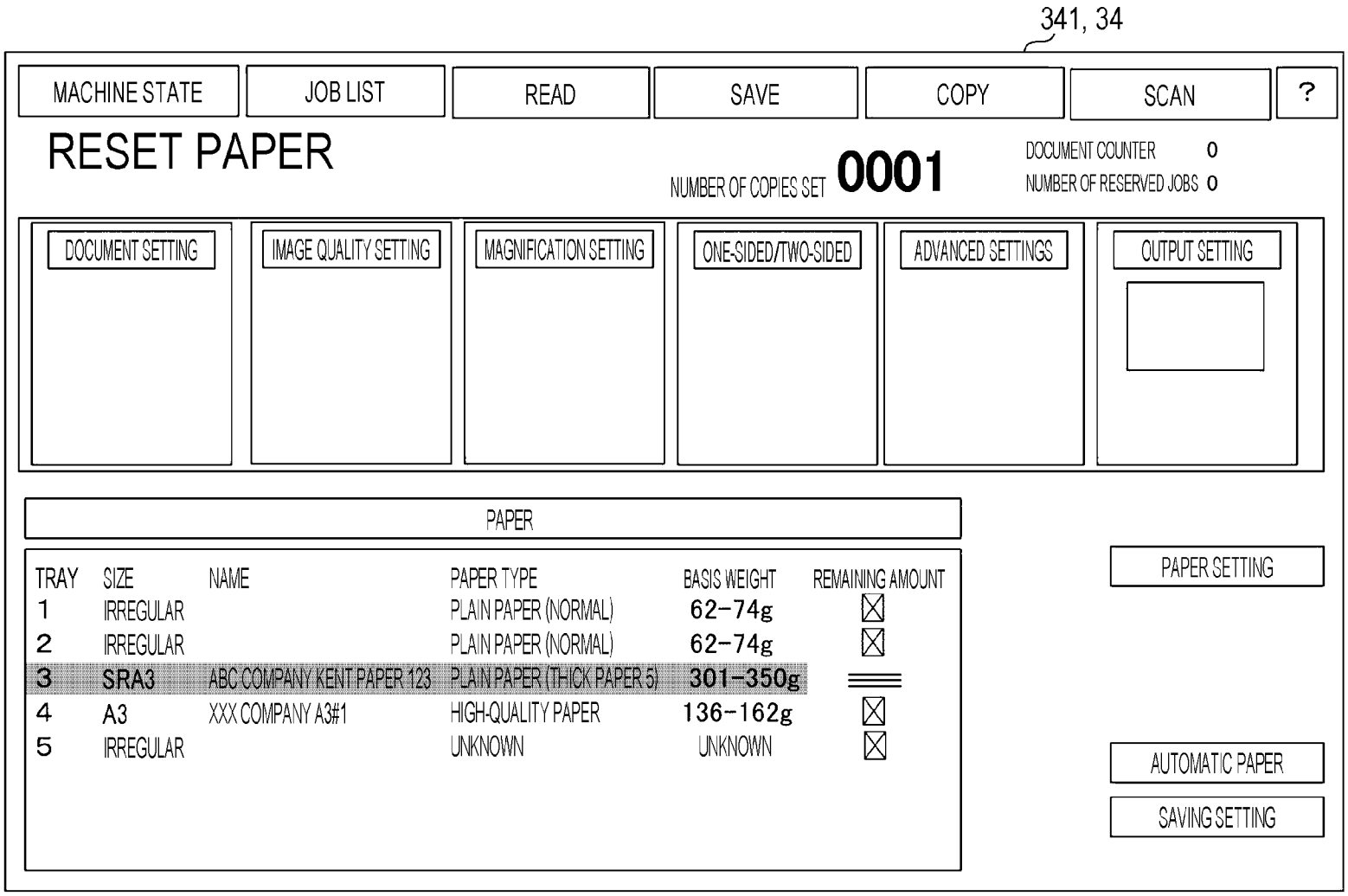
FIG. 21 is a screen example of an operation display in which display prompting paper reset is performed.

FIG. 21 is a screen example of an operation display 34 in which display prompting paper reset is performed.

As illustrated in FIG. 21, in S1105, a message such as "Reset paper 90" is displayed on the operation display 34 according to an instruction from the controller 21.

Accordingly, according to the fifth embodiment, in a case where it takes a predetermined time or longer to move the regulation plates 252*b* and 252*d*, it is possible to stop the movement of the regulation plates 252*b* and 252*d*, assuming that there is some abnormality. Further, according to the fifth embodiment, in a case where it takes the predetermined time or longer to move the regulation plates 252*b* and 252*d*, a message prompting the user to reset the paper 90 is displayed. Accordingly, according to the fifth embodiment, it is possible to immediately eliminate simple abnormality that occurs when the regulation plates 252*b* and 252*d* are moved, such as a failure in setting the paper 90.

The present invention is not limited to the embodiments described above. The conditions, numerical values, and the like used in the description of the embodiments are merely exemplary, and do not restrict the present invention.

A program according to an embodiment of the present invention can be implemented with a dedicated hardware circuit. The program can be provided by a computer-readable recording medium such as a universal serial bus (USB) memory or a digital versatile disc-read only memory (DVD-ROM), or can be provided online via a network such as the Internet without depending on a recording medium. In a case where the program is provided online, the program is recorded on a recording medium (storage 240) such as a magnetic disk in a computer connected to a network.

Embodiments of the present invention can be variously modified on the basis of the configurations set forth in the claims, and such modifications are also within the scope of the present invention.

Although embodiments of the present invention have been described and illustrated in detail, the disclosed embodiments are made for purposes of illustration and example only and not limitation. The scope of the present invention should be interpreted by terms of the appended claims.

What is claimed is:

1. A paper feed device having regulation plates that are movable on a paper feed tray for loading paper and regulate edges of the paper, the paper feed device comprising:

a driver that moves the regulation plates to be in contact with edge surfaces of a loaded paper; and a hardware processor that acquires paper information corresponding to a characteristic of the loaded paper detected by a paper information detector, and causes the driver to move the regulation plates to positions in contact with the edge surfaces of the loaded paper based on the acquired paper information detected by the paper information detector so as to align edges of the loaded paper in an appropriate position, wherein the paper information includes moisture content, and the hardware processor sets an interval between the regulation plates of a case where the moisture content is equal to or more than a predetermined value wider than an interval between the regulation plates of a case where the moisture content is less than the predetermined value.

2. The paper feed device according to claim 1, wherein the hardware processor includes the paper information detector that detects, from the paper, at least one more characteristic selected from among groups of paper type of the paper, basis weight of the paper, charging rate of the paper, and smoothness of the paper, as the paper information.

3. The paper feed device according to claim 2, wherein the paper information detector is disposed on a conveyance path for the paper.

4. The paper feed device according to claim 2, wherein the paper information detector is disposed at a position where the paper is loaded.

5. The paper feed device according to claim 2, wherein the hardware processor causes the regulation plates to move to positions based on at least either the paper information obtained from an input type of the paper or the paper information detected by the paper information detector.

6. The paper feed device according to claim 1, wherein the hardware processor includes a paper type inputter that receives, from a user, input of information of a type of the paper.

7. The paper feed device according to claim 1, the paper feed device further comprising a storage that stores a paper profile including the paper information and position information of the regulation plates, the position information corresponding to the paper profile, wherein the hardware processor includes a paper profile inputter that receives input of the paper profile from a user, and the hardware processor acquires positions of the regulation plates from the storage, the positions corresponding to the input paper profile, and causes the regulation plates to move.

8. The paper feed device according to claim 7, wherein the paper profile includes at least one piece of information selected from among groups of paper type of the paper, basis weight of the paper, and image formation condition for the paper, as the paper information.

9. The paper feed device according to claim 1, wherein, after the paper is loaded in the paper feed tray, the hardware processor causes the regulation plates to move until force of a predetermined amount or more is applied to the regulation plates, and further causes the regulation plates to move to positions based on the paper information.

10. The paper feed device according to claim 1, the paper feed device further comprising an environment detector that detects at least either temperature or humidity inside and/or outside the paper feed device as environment information, wherein the hardware processor causes the regulation plates to move to positions based on the environment information and the paper information.

11. The paper feed device according to claim 1, the paper feed device further comprising an event information storage that stores, in association with one another, positions of the regulation plates at a time of paper feeding, the paper information, and conveyance stop occurrence information of a case where conveyance of the paper is stopped after the paper is fed and conveyed, wherein the hardware processor causes the regulation plates to move to positions based on information stored in the event information storage.

12. The paper feed device according to claim 11, the paper feed device further comprising an environment detector that detects at least either temperature or humidity inside and/or outside the paper feed device as environment information, wherein the hardware processor causes the regulation plates to move to positions based on the environment information and the paper information, and wherein the event information storage further stores the environment information in association with the positions of the regulation plates, the paper information, and the conveyance stop occurrence information.

13. The paper feed device according to claim 11, wherein the conveyance stop occurrence information is paper feed jam occurrence information.

14. The paper feed device according to claim 13, wherein the paper feed jam occurrence information is first jam information, the first jam being caused by an interval between the regulation plates being narrower than a predetermined interval, and is second jam information, the second jam being caused by an interval between the regulation plates being wider than a predetermined interval.

15. The paper feed device according to claim 1, wherein the paper information includes a charging rate, and the hardware processor sets an interval between the regulation plates of a case where the charging rate is equal to or more than a predetermined value wider than an interval between the regulation plates of a case where the charging rate is less than the predetermined value.

16. The paper feed device according to claim 1, wherein the hardware processor notifies a user of information, and the hardware processor provides notification of reset of the paper in a case where the regulation plates fail to complete movement to positions based on the paper information within a preset time period.

17. An image formation system comprising:

the paper feed device according to claim 1; and an image formation device that forms an image on paper fed from the paper feed device.

18. A paper feed device having regulation plates that are movable on a paper feed tray for loading paper and regulate edges of the paper, the paper feed device comprising:

a driver that moves the regulation plates to be in contact with edge surfaces of a loaded paper; and a hardware processor that acquires paper information corresponding to a characteristic of the loaded paper detected by a paper information detector, and causes the driver to move the regulation plates to positions in contact with the edge surfaces of the loaded paper based on the acquired paper information detected by the paper information detector so as to align edges of the loaded paper in an appropriate position, wherein the paper information includes smoothness of edge surfaces the paper, and the hardware processor sets an interval between the regulation plates of a case where the smoothness is less than a predetermined value wider than an interval between the regulation plates of a case where the smoothness is equal to or more than the predetermined value.

19. A non-transitory recording medium storing a computer readable control program for a paper feed device having regulation plates that are movable on a paper feed tray for loading paper and regulate edges of the paper, and a driver that moves the regulation plates to be in contact with edge surfaces of a loaded paper, the non-transitory recording medium storing a computer readable control program causing a computer to perform:

acquiring paper information corresponding to a characteristic of the loaded paper detected by a paper information detector, wherein the paper information includes moisture content;

causing the driver to move the regulation plates to be in contact with edge surfaces of the loaded paper and to move to positions based on the acquired paper information detected by the paper information detector so as to align edges of the loaded paper in an appropriate position, and setting an interval between the regulation plates of a case where the moisture content is equal to or more than a predetermined value wider than an interval between the regulation plates of a case where the moisture content is less than the predetermined value.

* * * * *